US009033232B2

(12) United States Patent
Bockmon

(10) Patent No.: US 9,033,232 B2
(45) **Date of Patent: *May 19, 2015**

(54) ACTIVE STABILIZATION TARGETING CORRECTION FOR HANDHELD FIREARMS

(71) Applicant: Rocky Mountain Scientific Laboratory, LLC, Littleton, CO (US)

(72) Inventor: Bryan Sterling Bockmon, Morrison, CO (US)

(73) Assignee: ROCKSIGHT HOLDINGS, LLC, Littleton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/870,174

(22) Filed: Apr. 25, 2013

(65) Prior Publication Data

US 2014/0332589 A1 Nov. 13, 2014

Related U.S. Application Data

(63) Continuation of application No. 13/214,414, filed on Aug. 22, 2011, now Pat. No. 8,453,368.

(60) Provisional application No. 61/375,642, filed on Aug. 20, 2010.

(51) Int. Cl.
*G06F 19/00* (2011.01)
*G06G 7/80* (2006.01)

(Continued)

(52) U.S. Cl.
CPC *F41G 3/005* (2013.01); *F41G 1/00* (2013.01); *F41A 27/30* (2013.01); *F41G 1/38* (2013.01); *F41G 3/06* (2013.01); *F41G 3/08* (2013.01); *F41G 3/12* (2013.01)

(58) Field of Classification Search
CPC ..... F41G 1/38; F41G 1/473; F41G 3/04; F41G 3/26; F41G 3/2655; F41G 3/2661; F41G 7/36; F41J 5/02; F41J 5/12
USPC ..... 235/400–408; 42/111, 122
See application file for complete search history.

(56) References Cited

U.S. PATENT DOCUMENTS

| | | | | |
|---|---|---|---|---|
| 4,402,250 | A * | 9/1983 | Baasch | 89/41.11 |
| 6,499,382 | B1 * | 12/2002 | Lougheed et al. | 89/41.05 |
| 6,886,287 | B1 * | 5/2005 | Bell et al. | 42/120 |
| 7,404,268 | B1 * | 7/2008 | Page | 42/137 |
| 7,703,719 | B1 * | 4/2010 | Bell et al. | 244/125 |
| 2005/0268521 | A1 * | 12/2005 | Cox et al. | 42/130 |
| 2009/0255160 | A1 * | 10/2009 | Summers | 42/70.01 |

(Continued)

*Primary Examiner* — Tuyen K Vo
(74) *Attorney, Agent, or Firm* — Bennet K. Langlotz; Langlotz Patent & Trademark Works, Inc.

(57) ABSTRACT

An electromechanical system translates an "aiming error" signal from a target tracking system into dynamic "pointing corrections" for handheld devices to drastically reduce pointing errors due to man-machine wobble without specific direction by the user. The active stabilization targeting correction system works by separating the "support" features of the handheld device from the "projectile launching" features, and controlling their respective motion by electromechanical mechanisms. When a target is visually acquired, the angular deflection (both horizontal windage and vertical elevation) and aiming errors due to man-machine wobble (both vertical and horizontal) from the target's location to the current point-of-aim can be quickly measured by the ballistic computer located internal to a target tracking device. These values are transmitted to calibrated encoded electromechanical actuators that position the isolated components to rapidly correct angular deflection to match the previous aiming error.

22 Claims, 21 Drawing Sheets

(51) Int. Cl.

| | |
|---|---|
| ***F41G 3/00*** | (2006.01) |
| ***F41G 1/00*** | (2006.01) |
| ***F41A 27/30*** | (2006.01) |
| ***F41G 1/38*** | (2006.01) |
| ***F41G 3/06*** | (2006.01) |
| ***F41G 3/08*** | (2006.01) |
| ***F41G 3/12*** | (2006.01) |

(56) References Cited

U.S. PATENT DOCUMENTS

| | | | | |
|---|---|---|---|---|
| 2009/0320348 | A1* | 12/2009 | Kelly | 42/119 |
| 2011/0114725 | A1* | 5/2011 | Young | 235/407 |
| 2011/0284634 | A1* | 11/2011 | Lee et al. | 235/404 |
| 2012/0042559 | A1* | 2/2012 | Bockmon | 42/111 |
| 2012/0126002 | A1* | 5/2012 | Rudich | 235/404 |

* cited by examiner

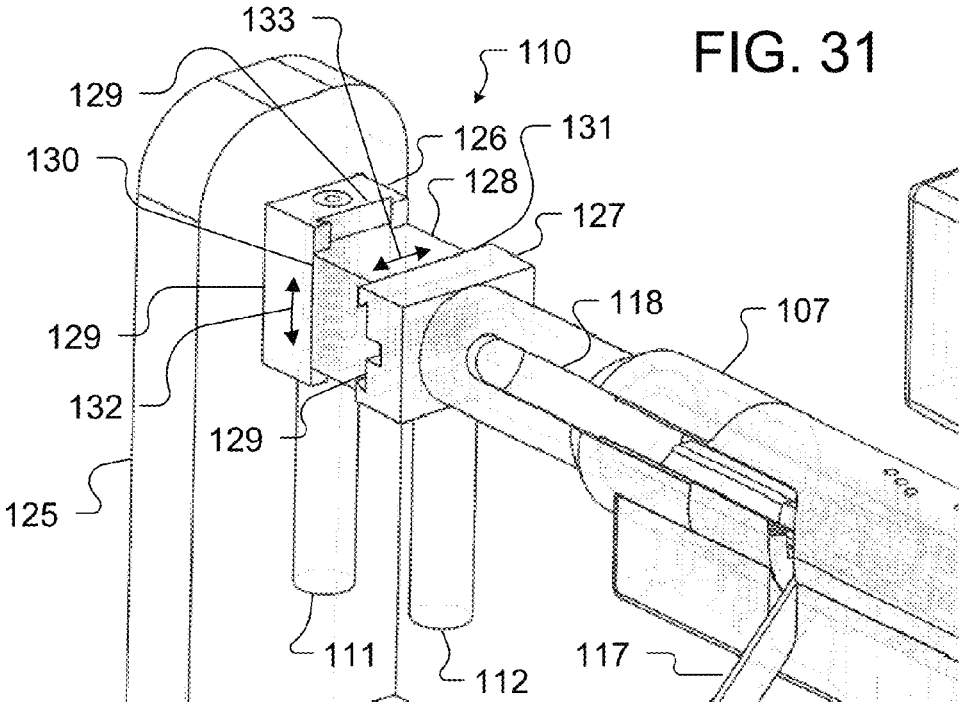
FIG. 31
FIG. 32
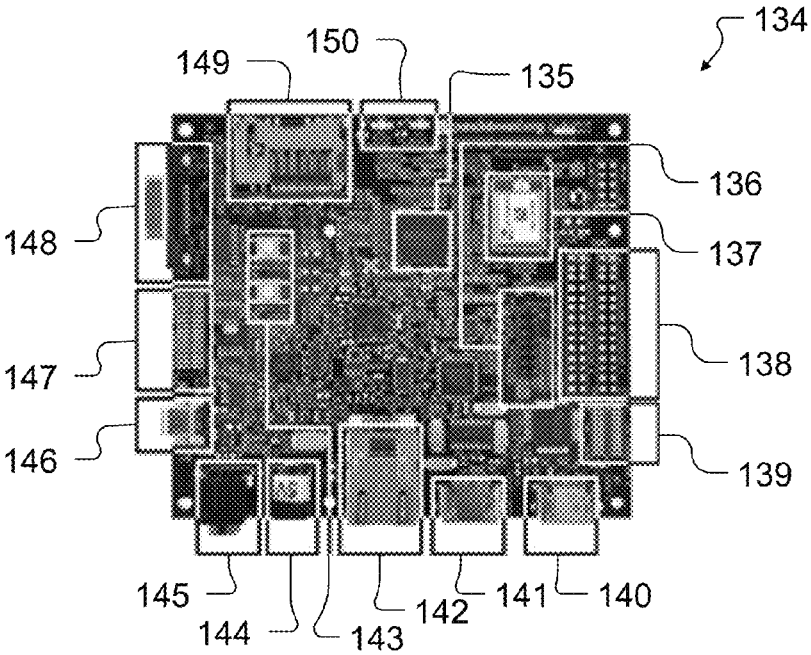

ACTIVE STABILIZATION TARGETING CORRECTION FOR HANDHELD FIREARMS

CROSS-REFERENCES TO RELATED APPLICATIONS

This application is a Continuation of U.S. patent application Ser. No. 13/214,414, filed Aug. 22, 2011, entitled "Active Stabilization Targeting Correction For Handheld Firearms," which claims the benefit of U.S. Provisional Application Ser. No. 61/375,642, filed on Aug. 20, 2010, entitled "Active Stabilization Targeting Correction For Handheld Devices," which are incorporated herein by reference in their entirety for all that is taught and disclosed therein.

BACKGROUND

The automation of fire-control technology has drastically improved hit-probabilities and reduced target-engagement times for almost all gun systems over the past century, but small-arms systems have lagged behind their larger brethren in improvements because of limitations in weight, power, size, and onboard computing power. Modern combat-proven optics have allowed major strides toward closing the gap, but because of the nature of the small-arms mission, the necessity of having a "human-in-the-loop" introduces natural human errors, referred to as man-machine wobble, into the fire-control solution.

SUMMARY

Correction of man-machine wobble errors is achieved by realigning the weapon's point of aim independently from the portion of the weapon system that interfaces with the shooter, e.g., the stocks, optics, and grips, each of which are mounted to a "carriage" that envelops the moving parts of the weapon system. This separation of the projectile-launching components of the weapon system from the user-interface components is controlled via target tracking software and embedded mobile processing hardware that optically monitor target position relative to point of aim. When the system is powered on, and the shooter activates a targeting button on the grip, the target tracking system detects the target and calculates its angular deflection from the standard line-of-sight ("LOS") of the weapon by comparing it to the standard aiming point (dot or reticle). Electromechanical actuators are activated to rapidly redirect the LOS of the barrel and receiver, separately from the standard LOS of the carriage, to actively stabilize the weapon direction relative to the target. This is a much simpler alternative to guided bullets and is an intelligent launch. In effect, this capability can continuously correct for man-machine wobble and erratic target movements. An electromechanical system continuously translates an "aiming error" signal from a target tracking system into dynamic "aiming corrections" for man-machine wobble for handheld devices by physically offsetting the direction of aim from the line-of-sight to the target to drastically reduce aiming errors without specific direction by the user. The electromechanical system improves the "hit" probabilities for handheld devices of all types, especially projectile launchers, including, but not limited to, firearms, paintball guns, grenade launchers, shoulder-fired rocket launchers, air soft guns, pellet/bb guns, crossbows, less/non-lethal weapons (e.g., tasers, acoustic beam, tear gas launchers, rubber slug launchers, bean-bag launchers, etc.), "tagging/marking" guns, and tranquilizer guns, etc. The system compensates for man-machine wobble in standing and unsupported firing positions, and other moving firing positions such as on trucks, aircraft, and boats. The system will also significantly reduce target acquisition time by offering shooters an effective "snap-to-target" capability and radically decreasing ammunition consumption rates.

BRIEF DESCRIPTION OF THE SEVERAL VIEWS OF THE DRAWINGS

FIG. 31 shows a perspective view of the guide block assembly of the rifle shown in FIG. 23 incorporating another embodiment of the active stabilization targeting correction of the present invention.

FIG. 32 shows a board used for data processing for the rifle shown in FIGS. 22 and 23 incorporating another embodiment of the active stabilization targeting correction of the present invention.

DETAILED DESCRIPTION

Figure 1:
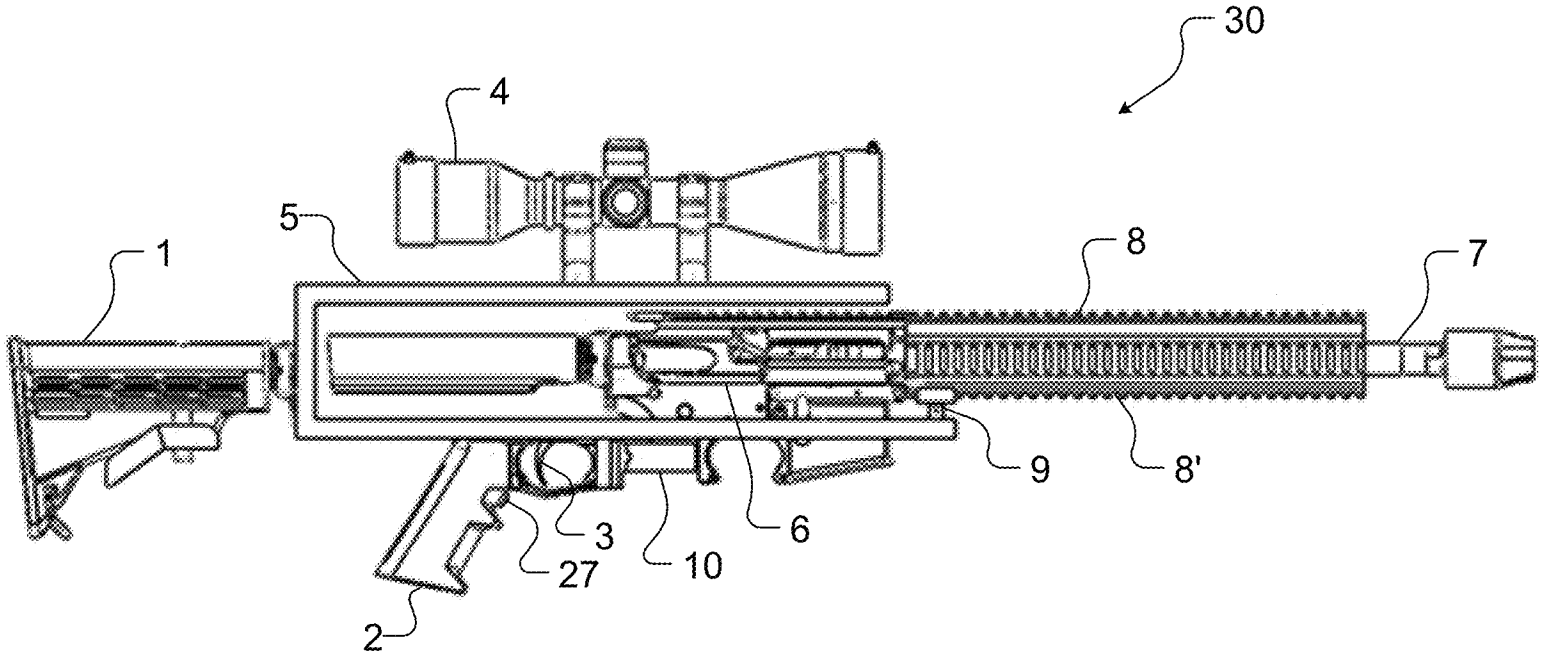
FIG. 1 shows an elevation view of a rifle incorporating an embodiment of the active stabilization targeting correction of the present invention.

With the computing environment in mind, embodiments of the present invention are described with reference to logical operations being performed to implement processes embodying various embodiments of the present invention. These logical operations are implemented (1) as a sequence of computer implemented steps or program modules running on a computing system and/or (2) as interconnected machine logic circuits or circuit modules within the computing system. The implementation is a matter of choice dependent on the performance requirements of the computing system implementing the invention. Accordingly, the logical operations making up the embodiments of the present invention described herein are referred to variously as operations, structural devices, acts or modules. It will be recognized by one skilled in the art that these operations, structural devices, acts and modules may be implemented in software, in firmware, in special purpose digital logic, and any combination thereof without deviating from the spirit and scope of the present invention as recited within the claims attached hereto.

Typical aiming systems for firearms provide a line-of-sight that intersects the projectile's trajectory at a predetermined distance, often called the "zero" range. This is usually around 25 meters for handguns, 50 meters for shotguns, 100 meters for small rifles, and 200 meters for large rifles. Shooters have traditionally been required to compensate for the elevation error of projectile impact when shooting targets at distances other than the zero range. This was usually accomplished by estimating the distance to target and utilizing alternate graduated aiming points built into the aiming system. Advanced commercially available aiming systems now utilize laser range finders to electronically measure the distance to a target when a shooter activates the system and points at the target. The aiming device then automatically corrects the aiming point to compensate for the elevation error. Technology is in development to also address aiming errors from wind-induced drift and other sources of dispersion of the projectile. These systems also transparently correct the aiming point for shooters. Once windage and elevation corrections have been accurately calculated by a ballistic computer and accounted for in the aiming system, there usually remains only one source of aiming error—shooter or man-machine wobble.

Man-machine wobble is the source of a continuously varying aiming error stemming from natural instability of the body of the shooter due to breathing, muscle movements, and other causes and with varying degrees of severity. Marksmanship is the act of minimizing man-machine wobble under various conditions and triggering the shot at optimal timing for accurate hits on target. Target tracking technology in conjunction with an electromechanical system of active stabilization targeting correction compensates for man-machine wobble, leaving the shooter free to optimize timing of the shot based on other factors, such as other nearby targets, orders to fire, etc. This is most important in situations of military combat fire-fights, law-enforcement maneuvers, and self-defense shootings when the shooters will be under duress and subject to significant destabilizing factors. The system is also of considerable interest for hunting applications where it will enhance ethical harvest of animals by decreasing instances of wounding shots and increasing the instances of kill shots.

Referring now to the Figures, in which like reference numerals refer to structurally and/or functionally similar elements thereof, FIG. 1 shows an elevation view of a rifle incorporating an embodiment of the active stabilization targeting correction of the present invention. Referring now to FIG. 1, the active stabilization targeting correction system is shown in conjunction with a functional prototype of an AR-15 rifle. The active stabilization targeting correction system works by separating the "support" features of the rifle from the "projectile launching" features, and controlling their respective motion by electromechanical mechanisms. FIG. 1 illustrates a functional configuration of the active stabilization targeting correction system. Actual manufactured hardware may be of different shapes and designs for particular applications than that shown in FIG. 1.

In FIG. 1, Buttstock 1, Hand Grip 2, Trigger 3, and Optical Target Tracking Device 4 are solidly mounted to Sub-Frame 5, which also serves as a fore grip for the shooter. Buttstock 1, Hand Grip 2, Trigger 3, Optical Target Tracking Device 4, and Sub-Frame 5 constitute the only points of interface or support of the shooter with Firearm 30, hereinafter referred to as the "Interface Components." The remaining elements of Firearm 30 are isolated from the shooter and comprise the projectile launching components of Firearm 30.

The Receiver 6 (which handles cartridge loading and unloading mechanisms), Barrel 7, Upper Accessory Rail 8, and Lower Accessory Rail 8' are movably mounted to Sub-Frame 5 at two points: a two-degree-of-freedom (2-DOF) Gimbals 9 at the rear of Lower Accessory Rail 8', and Windage-Elevation Translation 10 fixed to Hand Grip 2. Receiver 6, Barrel 7, Upper Accessory Rail 8, and Lower Accessory Rail 8' are isolated from the shooter, hereinafter referred to as the "Isolated Components."

A target lock signal is generated when the shooter presses and holds Targeting Button 27, which is typically located on or near Hand Grip 2 of the dominant hand of the shooter or the fore-grip of the non-dominant hand so that Targeting Button 27 is automatically depressed when the shooter grasps Hand Grip 2 or the fore-grip tightly. When Optical Target Tracking Device 4 locates the desired target, the ballistic computer quickly calculates aiming point corrections for constant or near-constant sources (range, elevation, azimuth, wind, spin-drift, Coriolis effect, etc.) and adjusts the aiming reticle. Simultaneously, the angular deflection from the target's location to the current point-of-aim is rapidly measured by Optical Target Tracking Device 4 and translated into vertical and horizontal component corrections. These two values are transmitted to calibrated encoded Electromechanical Actuators 11 and 11', located within Block 21 (see FIG. 3) that position the Windage-Elevation Guide Blocks 10 accordingly to rapidly correct angular deflection of the Isolated Components (Receiver 6/Barrel 7/Upper Accessory Rail 8/Lower Accessory Rail 8') to compensate for the previous aiming error. Electromechanical Actuators 11 and 11' may be stepper motors, linear actuators, piezoelectric actuators, screw transducers, hydraulic, pneumatic, or any other type of actuator capable of the micro movements required.

Figure 2:
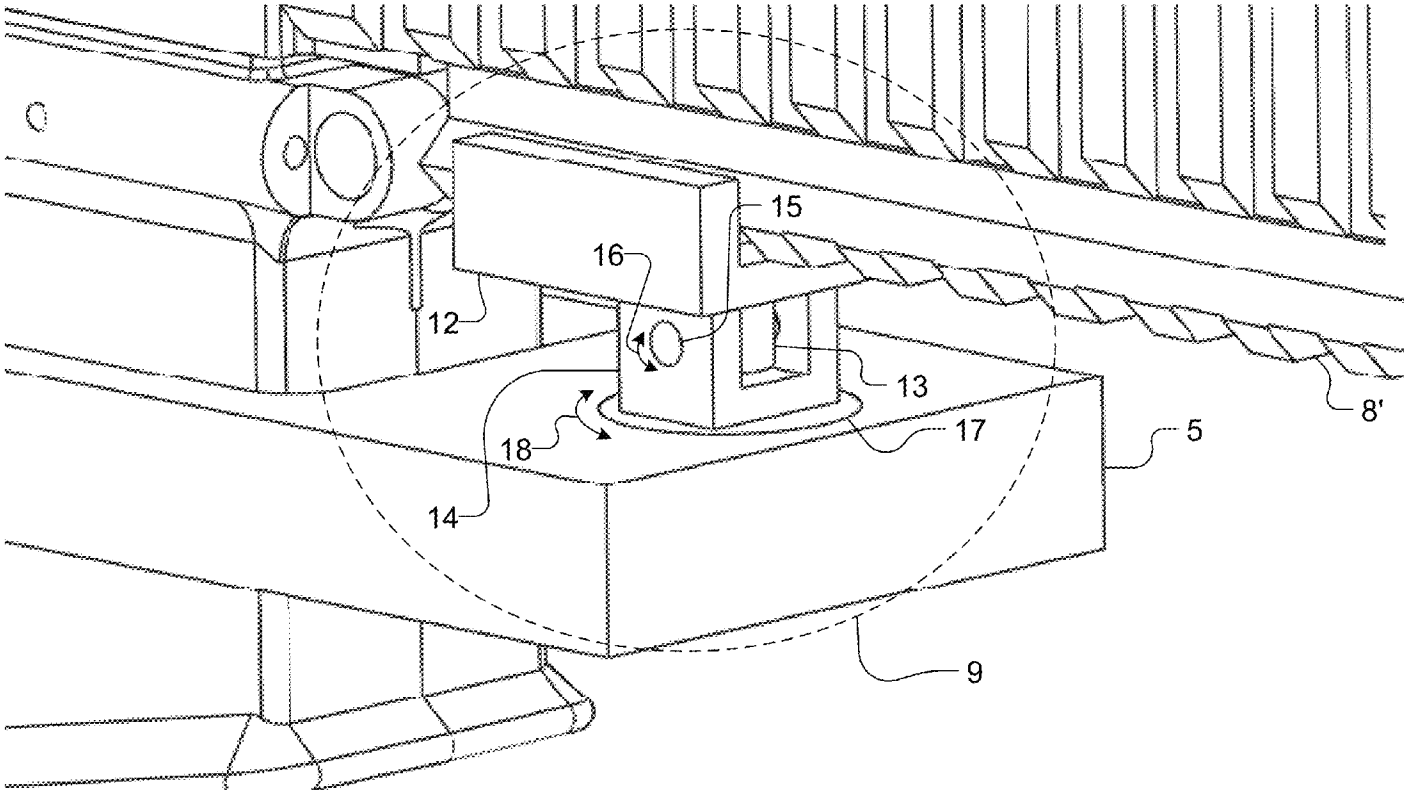
FIG. 2 shows an enlarged isometric view of an embodiment of the gimbals shown in FIG. 1.

FIG. 2 shows an enlarged isometric view of an embodiment of the gimbals shown in FIG. 1. Referring now to FIG. 2, the 2-DOF Gimbals 9 are comprised of an Attachment Bracket 12 that is secured to Lower Accessory Rail 8'. Tang 13 is solidly attached to Attachment Bracket 12 and extends downward where it is received within U-Bracket 14 via Pin 15 which passes through Tang 13. Pin 15 allows vertical panning/rotation of the Isolated Components as indicated by Arrow 16 and in cooperation with Windage-Elevation Translation 10. U-Bracket 14 is solidly mounted to a vertically pinned Turret 17, which is fixed within Sub-Frame 5, allowing horizontal panning/rotation of the Isolated Components as indicated by Arrow 18.

Figure 3:
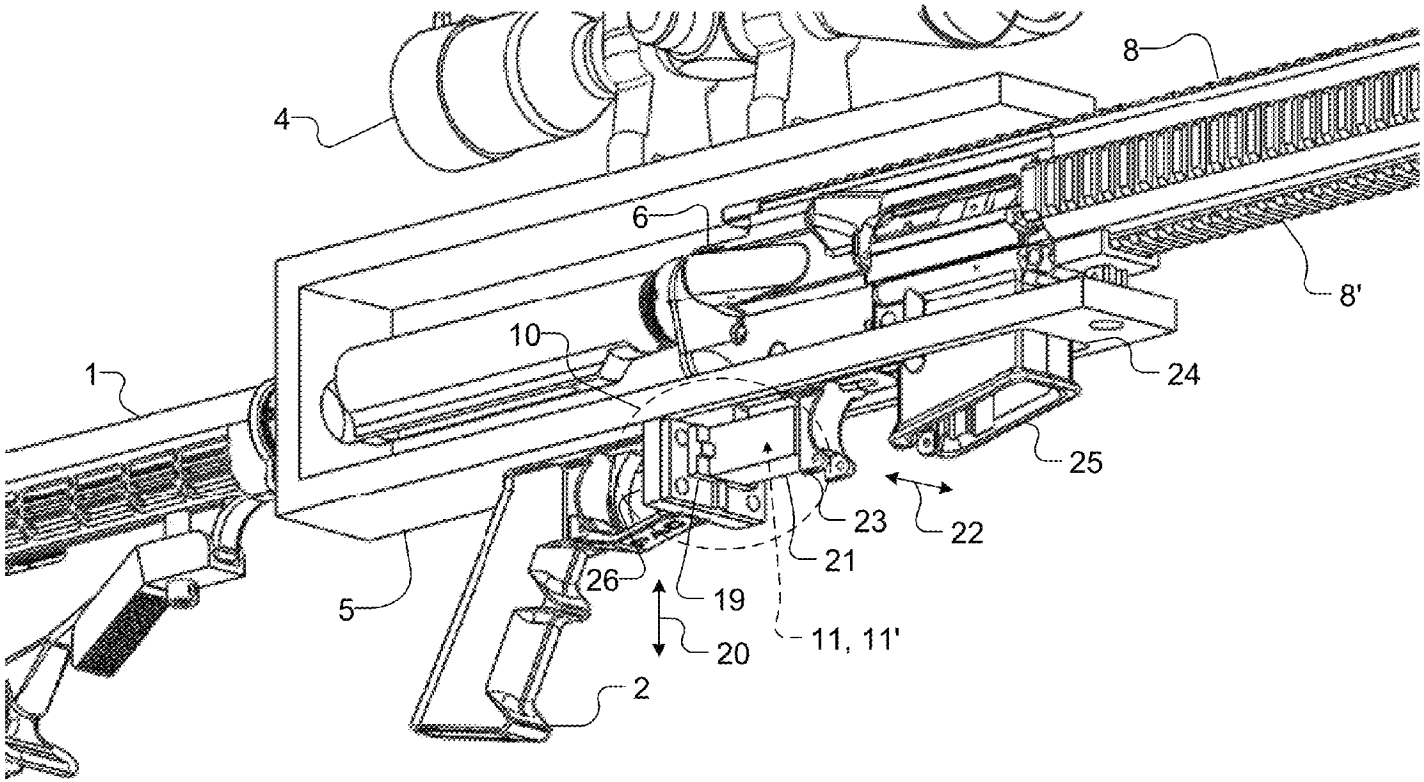
FIG. 3 shows an enlarged isometric view of an embodiment of the windage-elevation translation shown in FIG. 1.

FIG. 3 shows an enlarged isometric view of an embodiment of the windage-elevation translation shown in FIG. 1. Referring now to FIG. 3, Windage-Elevation Translation 10 is comprised of a Base Plate 26 which is solidly mounted to Sub-Frame 5. Movable Plate 19 translates up and down against Base Plate 26 in the directions indicated by Arrow 20. Block 21 translates back and forth against Movable Plate 19 in the horizontal directions indicated by Arrow 22. Block 21 is solidly mounted to Mounting Block 23 of Receiver 6. A Cutout 24 in a lower portion of Sub-Frame 5 allows for the protrusion of Magazine Well 25. Cutout 24 is only required on rifles with high-capacity magazines. Most sporting shotguns, rifles, and some handguns would allow for simpler configurations, as shown in FIGS. 4-16.

Figure 4:
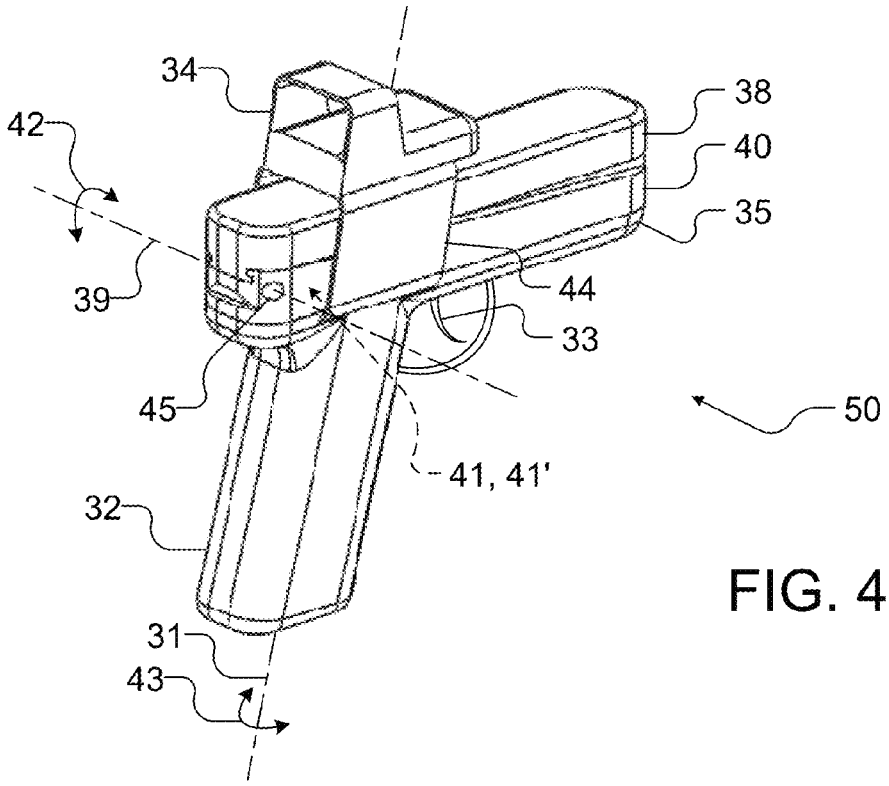
FIG. 4 shows a perspective view of a handgun incorporating an embodiment of the active stabilization targeting correction of the present invention.

FIG. 4 shows a perspective view of a handgun incorporating an embodiment of the active stabilization targeting correction of the present invention. Referring now to FIG. 4, Hand Grip 32, Trigger 33, and Optical Target Tracking Device 34 are solidly mounted to Sub-Frame 35 of Firearm 50. Optical Target Tracking Device 34 is mounted to U-Bracket 44 which is solidly mounted to Sub-Frame 35. Elevation Correction Sub-Frame 38 and Windage-Correction Sub-Frame 40 are free to move unhindered within U-Bracket 44. Hand Grip 32, Trigger 33, Optical Target Tracking Device 34, U-Bracket 44, and Sub-Frame 35 constitute the only points of interface with the shooter with Firearm 50, hereinafter referred to as the "Interface Components." The remaining elements of Firearm 50 are isolated from the shooter.

Elevation Correction Sub-Frame 38, which contains Barrel 37, and Windage-Correction Sub-Frame 40 are movably mounted to Sub-Frame 35 and form the Isolated Components from the shooter. Firearm 50 will typically have an ammunition box magazine (not shown) which can be part of the Isolated Components, but more typically be affixed to Hand Grip 32. Semi-auto handgun mechanisms allow for slight misalignments when feeding ammunition. Pin 45 is solidly mounted to Sub-Frame 40. Elevation Correction Sub-Frame 38 rotates about Pin 45 to raise or lower the elevation (vertical panning/rotation) of the end of Barrel 37 in the directions indicated by Arrow 42 around Axis 39 which is the centerline of Pin 45. Windage-Correction Sub-Frame 40 rotates about Axis 31 and parallel to Top Surface 36 (see FIG. 12) of Sub-Frame 35 in the directions indicated by Arrow 43 (horizontal panning/rotation) causing the end of barrel 37 to pan left or right in plan. This may be accomplished with a turret mechanism located in similar to Turret 17 shown in FIG. 2, with the exception that the turret has a hole through which the ammunition box magazine protrudes.

A target lock signal is generated when the shooter presses and holds Targeting Button 47, which is typically located on or near Hand Grip 32 of the dominant hand of the shooter so that Targeting Button 47 is automatically depressed when the shooter grasps Hand Grip 32. When Optical Target Tracking Device 34 locates the desired target, the angular deflection (both horizontal windage and vertical elevation) from the target's location to the current point-of-aim can be quickly measured by the ballistic computer located internal to Optical Target Tracking Device 34. These two values are transmitted to calibrated encoded Electromechanical Actuators 41 and 41', located within the rear end of Windage-Correction Sub-Frame 40 that position Elevation Correction Sub-Frame 38 and Windage-Correction Sub-Frame 40 accordingly to rapidly correct angular deflection of the Isolated Components (Elevation Correction Sub-Frame 38/Barrel 37/Windage-Correction Sub-Frame 40) to match the previous aiming error.

Figure 5:
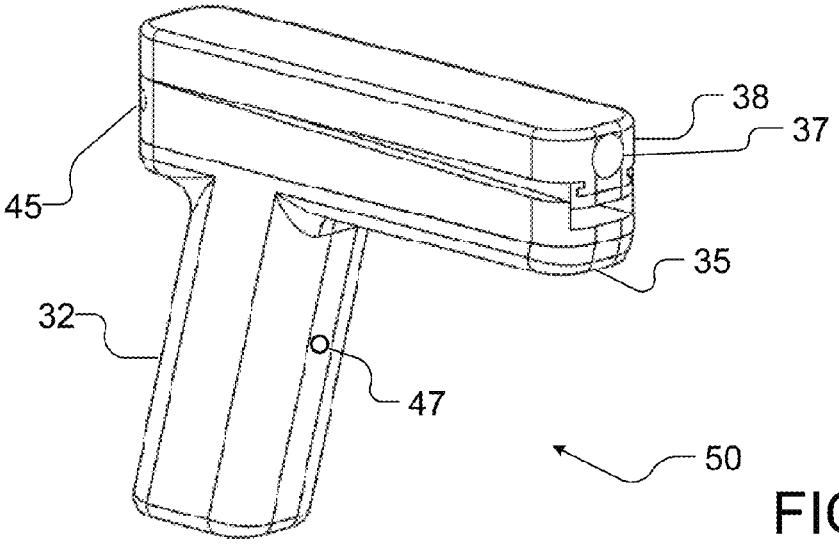
FIG. 5 shows a perspective view of a handgun incorporating an embodiment of the active stabilization targeting correction of the present invention.

FIG. 5 shows a perspective view of a handgun incorporating an embodiment of the active stabilization targeting correction of the present invention. Referring now to FIG. 5, a straightforward condition of zero degrees elevation and zero degrees windage is shown. (Trigger 33 and Optical Target Tracking Device 34 are not shown.)

Figure 6:
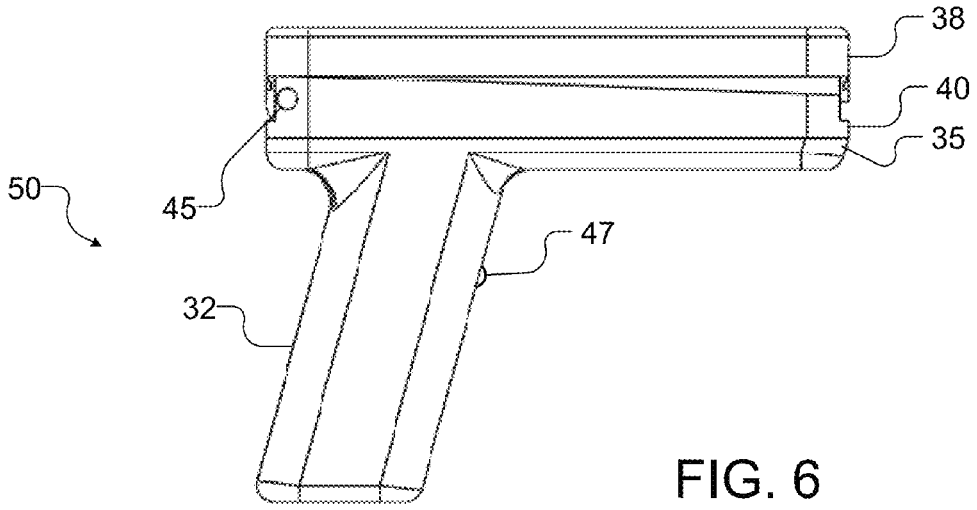
FIG. 6 shows an elevation view of a handgun incorporating an embodiment of the active stabilization targeting correction of the present invention.

FIG. 6 shows an elevation view of a handgun incorporating an embodiment of the active stabilization targeting correction of the present invention. Referring now to FIG. 6, a straightforward condition of zero degrees down elevation and zero degrees windage is shown. (Trigger 33 and Optical Target Tracking Device 34 are not shown.)

Figure 7:
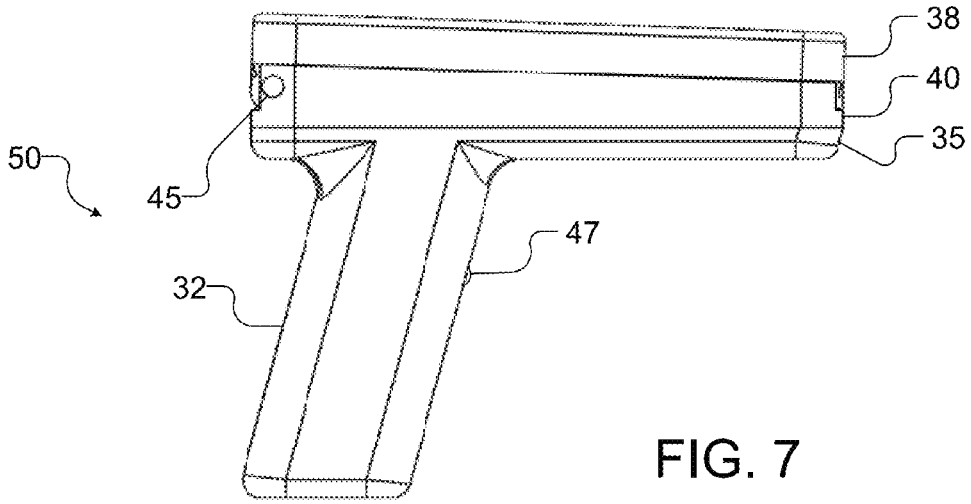
FIG. 7 shows an elevation view of a handgun incorporating an embodiment of the active stabilization targeting correction of the present invention.

FIG. 7 shows an elevation view of a handgun incorporating an embodiment of the active stabilization targeting correction of the present invention. Referring now to FIG. 7, a corrected condition of two degrees down elevation and zero degrees windage is shown. (Trigger 33 and Optical Target Tracking Device 34 are not shown.)

Figure 8:
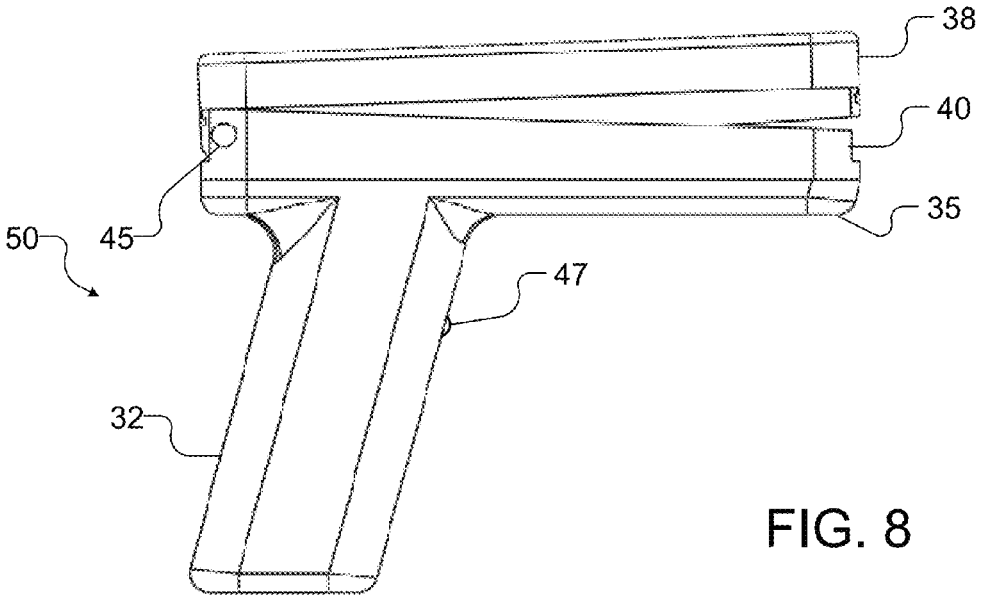
FIG. 8 shows an elevation view of a handgun incorporating an embodiment of the active stabilization targeting correction of the present invention.

FIG. 8 shows an elevation view of a handgun incorporating an embodiment of the active stabilization targeting correction of the present invention. Referring now to FIG. 8, a corrected condition of two degrees up elevation and zero degrees windage is shown. (Trigger 33 and Optical Target Tracking Device 34 are not shown.)

Figure 9:
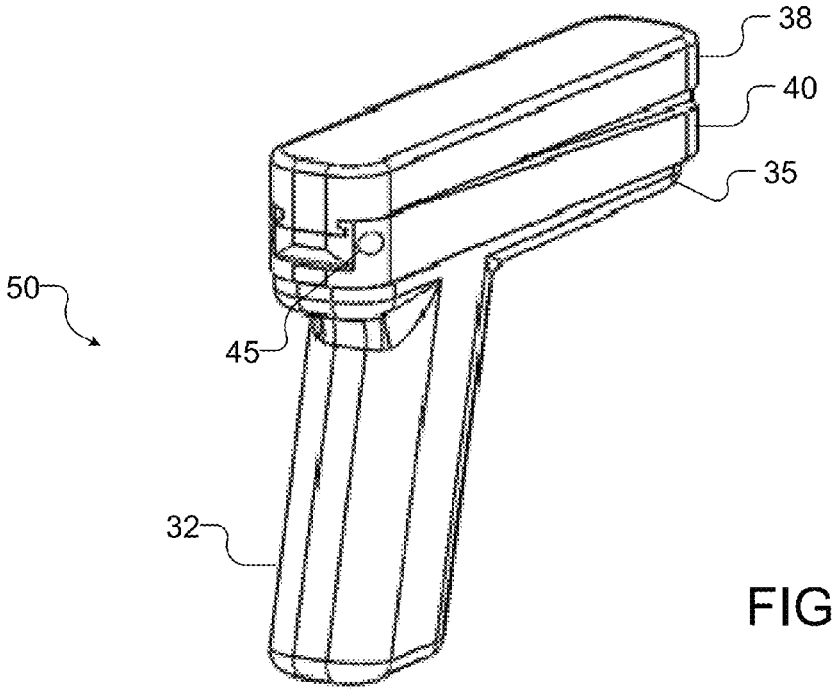
FIG. 9 shows a perspective view of a handgun incorporating an embodiment of the active stabilization targeting correction of the present invention.

FIG. 9 shows a perspective view of a handgun incorporating an embodiment of the active stabilization targeting correction of the present invention. Referring now to FIG. 9, a corrected condition of zero degrees elevation and two degrees right windage is shown. (Trigger 33 and Optical Target Tracking Device 34 are not shown.)

Figure 10:
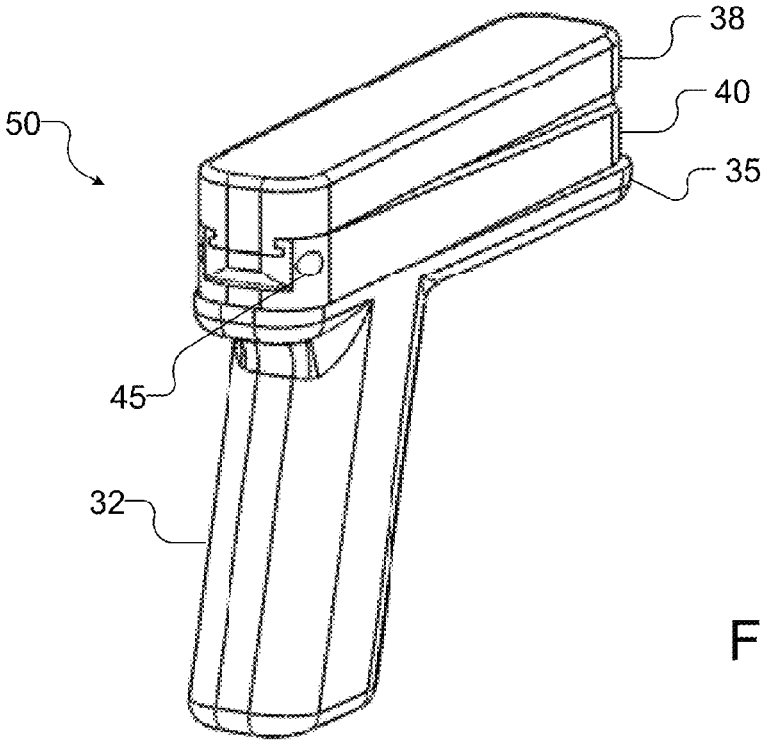
FIG. 10 shows a perspective view of a handgun incorporating an embodiment of the active stabilization targeting correction of the present invention.

FIG. 10 shows a perspective view of a handgun incorporating an embodiment of the active stabilization targeting correction of the present invention. Referring now to FIG. 10, a corrected condition of zero degrees elevation and two degrees left windage is shown. (Trigger 33 and Optical Target Tracking Device 34 are not shown.)

Figure 11:
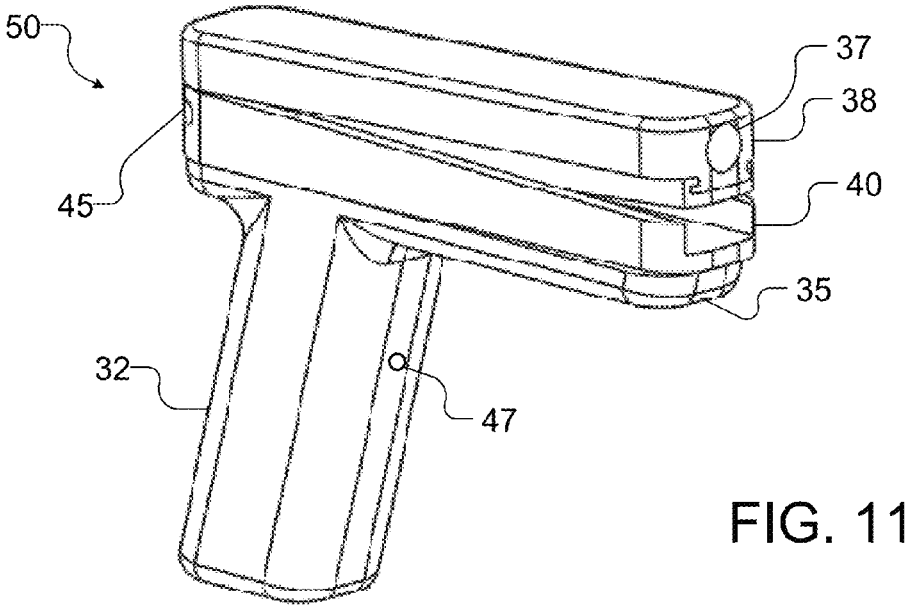
FIG. 11 shows a perspective view of a handgun incorporating an embodiment of the active stabilization targeting correction of the present invention.

FIG. 11 shows a perspective view of a handgun incorporating an embodiment of the active stabilization targeting correction of the present invention. Referring now to FIG. 11, a corrected condition of two degrees up elevation and two degrees left windage is shown. (Trigger 33 and Optical Target Tracking Device 34 are not shown.) From these different examples it can be seen that Elevation Correction Sub-Frame 38 and Windage-Correction Sub-Frame 40 move in unison when a windage correction is made, and Elevation Correction Sub-Frame 38 moves up or down in relation to Windage-Correction Sub-Frame 40 when an elevation correction is made.

Figure 12:
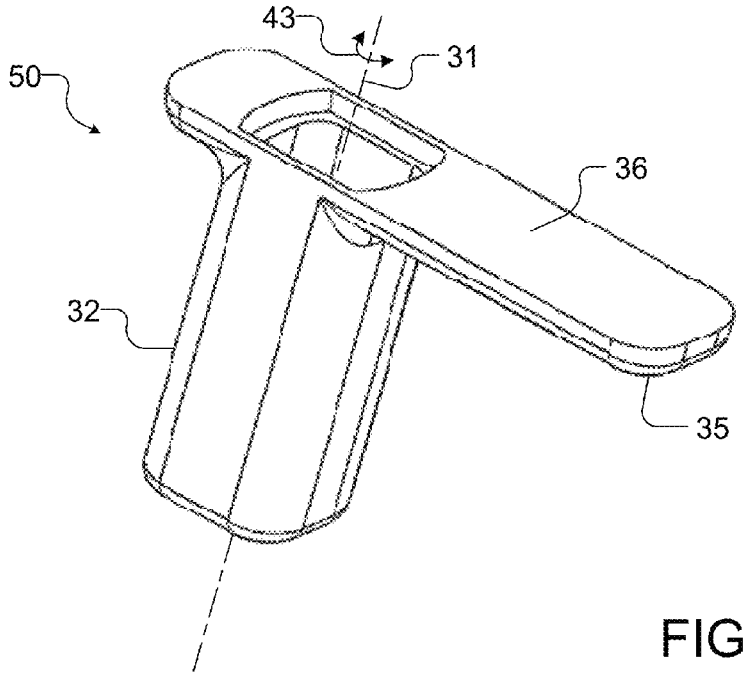
FIG. 12 shows a partial cutaway perspective view of a handgun incorporating an embodiment of the active stabilization targeting correction of the present invention.

FIG. 12 shows a partial cutaway perspective view of a handgun incorporating an embodiment of the active stabilization targeting correction of the present invention. Referring now to FIG. 12, Axis 31 is the rotational axis of Windage-Correction Sub-Frame 40 which rotates in the directions indicated by Arrow 43 in a plane parallel to Top Surface 36 of Sub-Frame 35. (Trigger 33, Optical Target Tracking Device 34, U-Bracket 44, Elevation Correction Sub-Frame 38, and Windage-Correction Sub-Frame 40 are not shown.)

Figure 13:
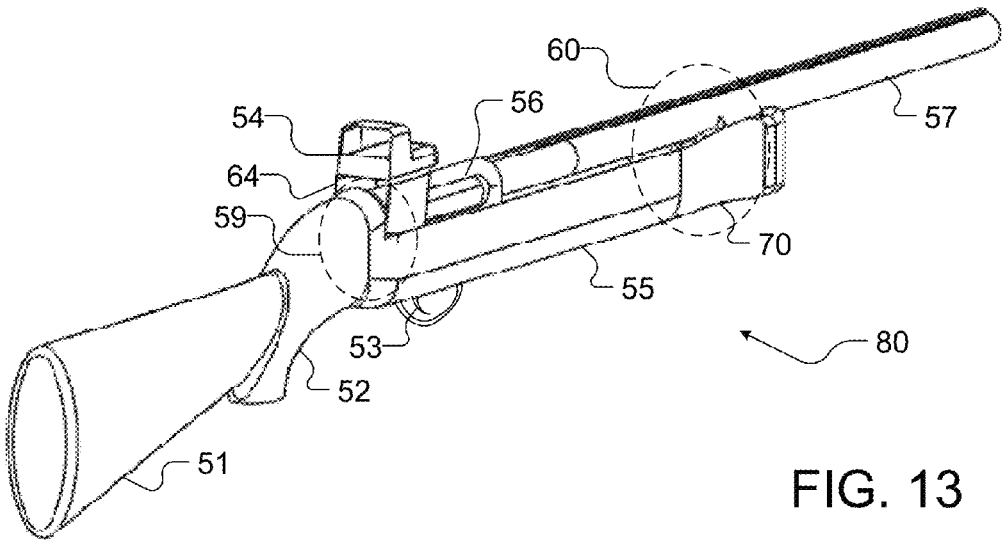
FIG. 13 shows a perspective view of a shotgun incorporating an embodiment of the active stabilization targeting correction of the present invention.
Figure 14:
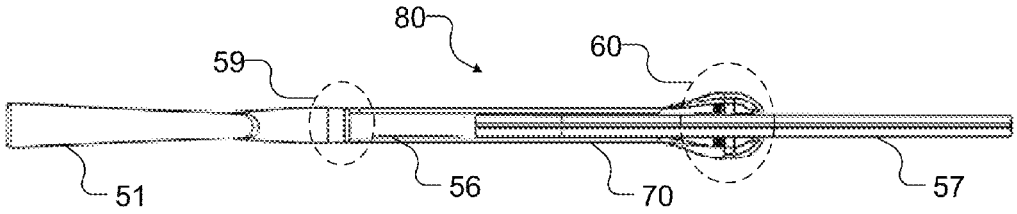
FIG. 14 shows a plan view of a shotgun incorporating an embodiment of the active stabilization targeting correction of the present invention.

FIG. 13 shows a perspective view of a shotgun incorporating an embodiment of the active stabilization targeting correction of the present invention, and FIG. 14 shows a plan view of a shotgun incorporating an embodiment of the active stabilization targeting correction of the present invention. Referring now to FIGS. 13 and 14, Buttstock 51, Hand Grip 52, Forestock 70, Trigger 53, and Optical Target Tracking Device 54 are solidly mounted to Sub-Frame 55 of Firearm 80. Optical Target Tracking Device 54 is mounted to U-Bracket 64 which is solidly mounted to Sub-Frame 55. Buttstock 51, Forestock 70, Trigger 53, Optical Target Tracking Device 54, and Sub-Frame 55 constitute the only points of interface with the shooter with Firearm 80, hereinafter referred to as the "Interface Components." The remaining elements of Firearm 80 are isolated from the shooter. (Optical Target Tracking Device 54 and U-Bracket 64 are not shown in FIG. 14.)

Receiver 56, Barrel 57, and Magazine Tube 58 are movably mounted to Sub-Frame 55 at two points: a two-degree-of-freedom (2-DOF) Gimbals 59 at the rear of Receiver 6, and Windage-Elevation Translation 60 at the fore end of Forestock 70. Receiver 56, Barrel 57, and Magazine Tube 58 form the Isolated Components from the shooter. (See FIGS. 15 and 16 for more details of these components.)

Figure 15:
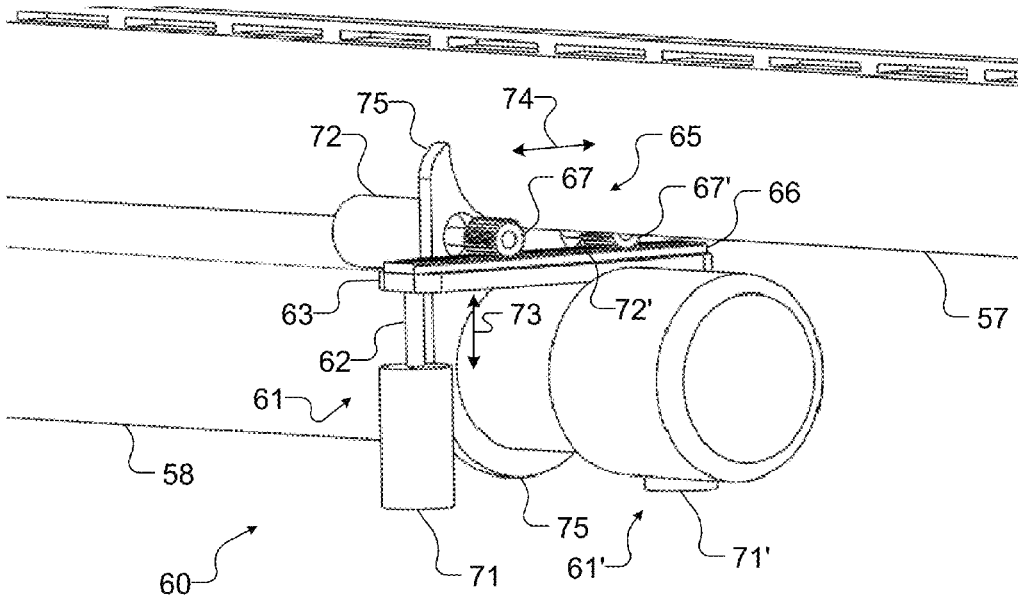
FIG. 15 shows an enlarged isometric view of an embodiment of the windage-elevation translation shown in FIGS. 13 and 14.

FIG. 15 shows an enlarged isometric view of an embodiment of the windage-elevation translation shown in FIGS. 13 and 14. Referring now to FIG. 15, Forestock 70 and Sub-Frame 55 have been removed to show the details of Windage-Elevation Translation 60. Elevation correction is accomplished by a pair of Linear Struts 61 and 61' which each are an assembly of Movable Rods 62 and 62' (Movable Rod 62' is not visible in FIG. 15) and Electromechanical Actuators 71 and 71'. Each bottom end of each Linear Strut 61 and 61' is solidly mounted to Sub-Frame 55. Mounting Bracket 75 solidly connects Barrel 57 to Magazine Tube 58. Movable Rods 62 and 62' of Linear Struts 61 and 61' are solidly mounted at their top ends to Lift Platform 63. Electromechanical Actuators 71 and 71' drive each Movable Rod 62 and 62' up or down in the directions indicated by Arrow 73 in order to correct the elevation of Barrel 57, with Magazine Tube 58 moving in unison due to connecting Mounting Bracket 75.

Rack and Pinion 65 cooperates with Lift Platform 63, Linear Struts 61 and 61', and Movable Rods 62 and 62'. Rack 66 is solidly mounted to Lift Platform 63. A pair of Pinions 67 and 67' engage with Rack 66 via their gear interface. Electromechanical Actuators 72 and 72' rotate each Pinion 67 and 67' causing Barrel 57 to move back and for the in the directions indicated by Arrow 74 in order to correct for windage.

A target lock signal is generated when the shooter presses and holds Targeting Button 78, which is typically located on or near Hand Grip 52 of the dominant hand of the shooter or the fore-grip of the non-dominant hand so that Targeting Button 78 is automatically depressed when the shooter grasps Hand Grip 52 or the fore-grip tightly. When Optical Target Tracking Device 54 locates the desired target, the angular deflection (both horizontal windage and vertical elevation) from the target's location to the current point-of-aim can be quickly measured by the ballistic computer located internal to Optical Target Tracking Device 54. These two values are transmitted to calibrated encoded Electromechanical Actuators 71 and 71' and Electromechanical Actuators 72 and 72' that rapidly correct angular deflection of the Isolated Components (Receiver 56/Barrel 57/Magazine Tube 58) to match the previous aiming error.

Figure 16:
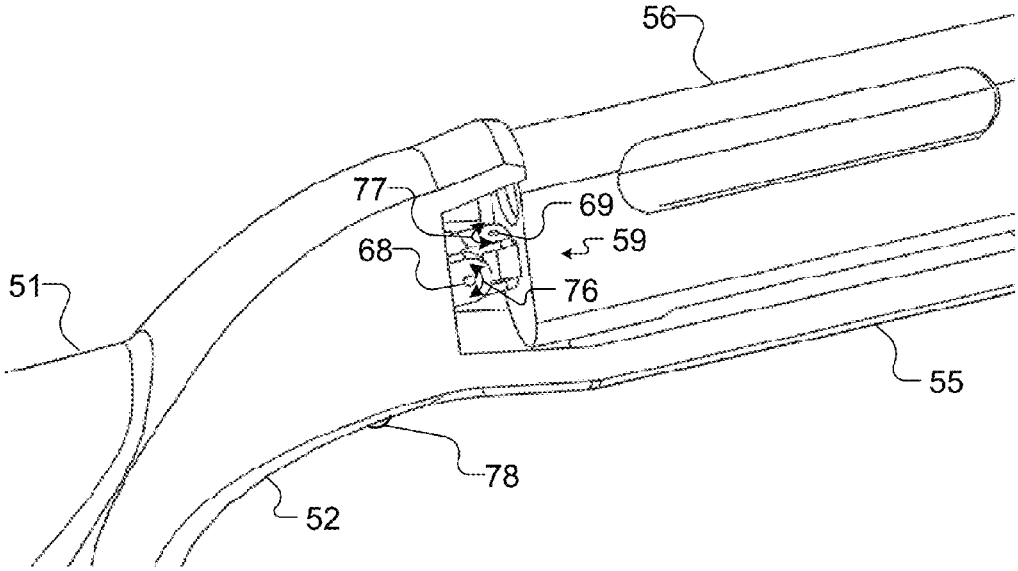
FIG. 16 shows an enlarged isometric view of an embodiment of the gimbals referenced in FIGS. 14 and 15.

FIG. 16 shows an enlarged isometric view of an embodiment of the gimbals referenced in FIGS. 14 and 15. Referring now to FIG. 16, the base of Gimbals 59 is attached to the fore end of Buttstock 51. The tip of Gimbals 59 is attached to the aft end of Receiver 56. When Linear Struts 61 and 61' are actuated by Electromechanical Actuator 71 and 71', the Isolated Components (Receiver 56/Barrel 57/Magazine Tube 58) rotate about Pin 68 in the directions indicated by Arrow 76. When Pinions 67 and 67' are actuated by Electromechanical Actuator 72 and 72' of Rack and Pinion 65, the Isolated Components (Receiver 56/Barrel 57/Magazine Tube 58) rotate about Pin 69 in the directions indicated by Arrow 77. (Trigger 53, Optical Target Tracking Device 54, and U-Bracket 64 are not shown in FIG. 16.)

Figure 17:
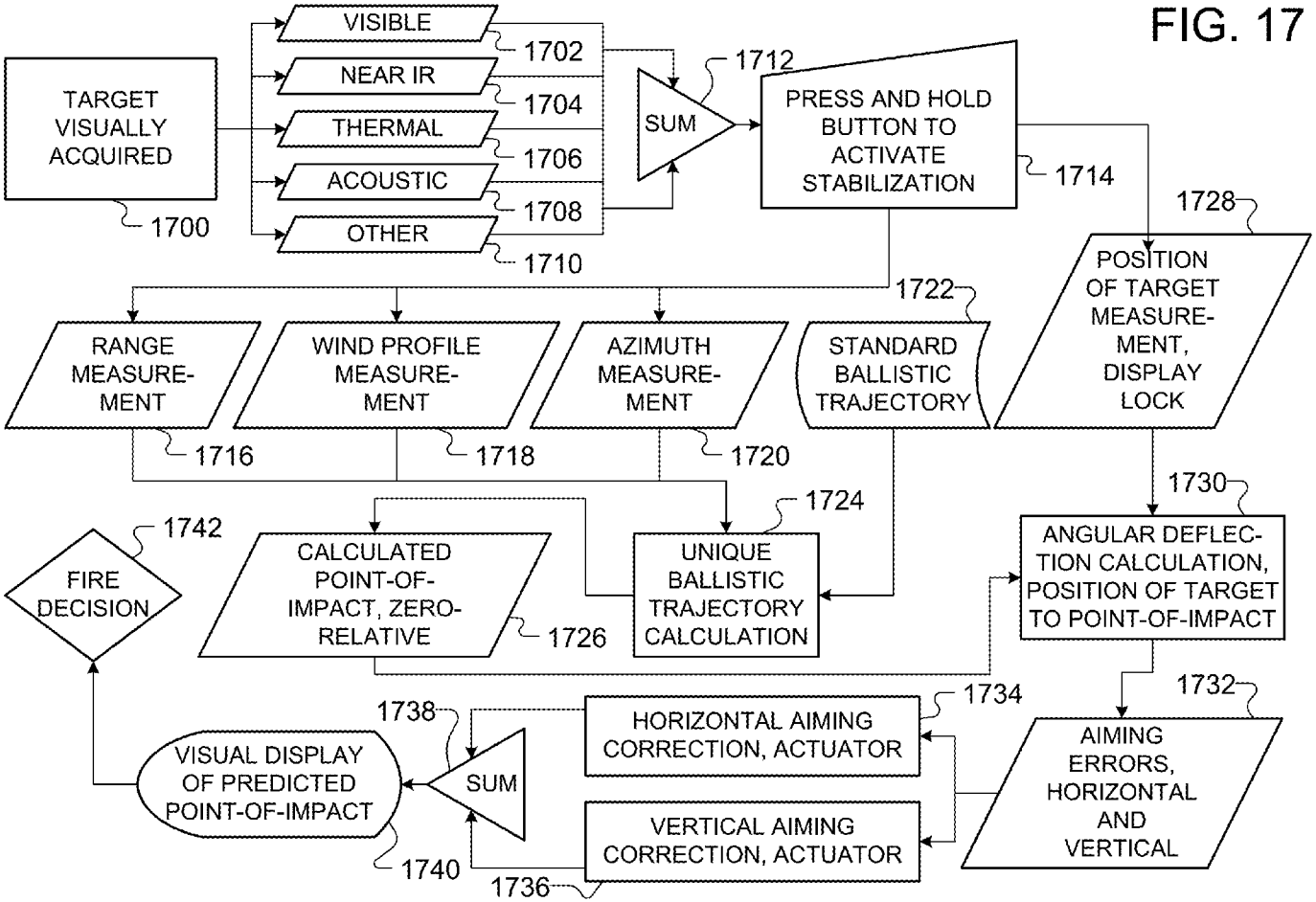
FIG. 17 shows a flow diagram of a method of utilizing an embodiment of the active stabilization targeting correction of the present invention.

FIG. 17 shows a flow diagram of a method of utilizing an embodiment of the active stabilization targeting correction of the present invention. Referring now to FIG. 17, the method begins with Block 1700 where a target is visually acquired by a shooter aiming a firearm, such as Firearms 30/50/80, and their associated optics, such as Optical Target Tracking Device 4/34/54, at a target, establishing a point-of-aim. Next, signals are generated by Optical Target Tracking Device 4/34/54 and in some embodiments, by other types of target detection devices in Blocks 1702-1710. The signals may be generated from visible light, near IR light, thermal imagery, acoustics, or any other type of target detecting signal. Particular embodiments may only employ one, two, or some other combination of the possible data acquisition systems. In Block 1712 all of the signals generated are summed, thus reducing the noise. In block 1714, the active stabilization targeting correction is activated when the shooter presses and holds a button, which is typically located on or near the grip of the dominant hand of the shooter or the fore-grip of the non-dominant hand so that the button is automatically depressed when the shooter grasps the hand grip or the fore-grip tightly and generates an activation signal. The button is in electrical communication with the embedded processor within Optical Target Tracking Devices 4/34/54.

Dual processing takes place after Block 1714. In the first processing path, in Block 1716 a range measurement is calculated, typically through a laser range finder system. In Block 1718 a wind profile measurement is calculated, typically through laser scattering. In Block 1720, an azimuth measurement is taken, typically through an electronic compass. In Block 1724, a unique ballistic trajectory is calculated with the data from Blocks 1716, 1718, and 1720 along with stored standard ballistic trajectory data from Block 1722. In Block 1726 a point-of-impact, zero-relative, is calculated. Depending upon the firearm in question, the data collected and generated in Blocks 3516-3526 is not needed in order to correct for man-machine wobble. For example, for a high powered rifle aiming at a target at less than 200 meters, the data generated from Blocks 3516-3526 would not alter significantly the man-machine wobble corrections generated in Block 3530.

Figure 34:
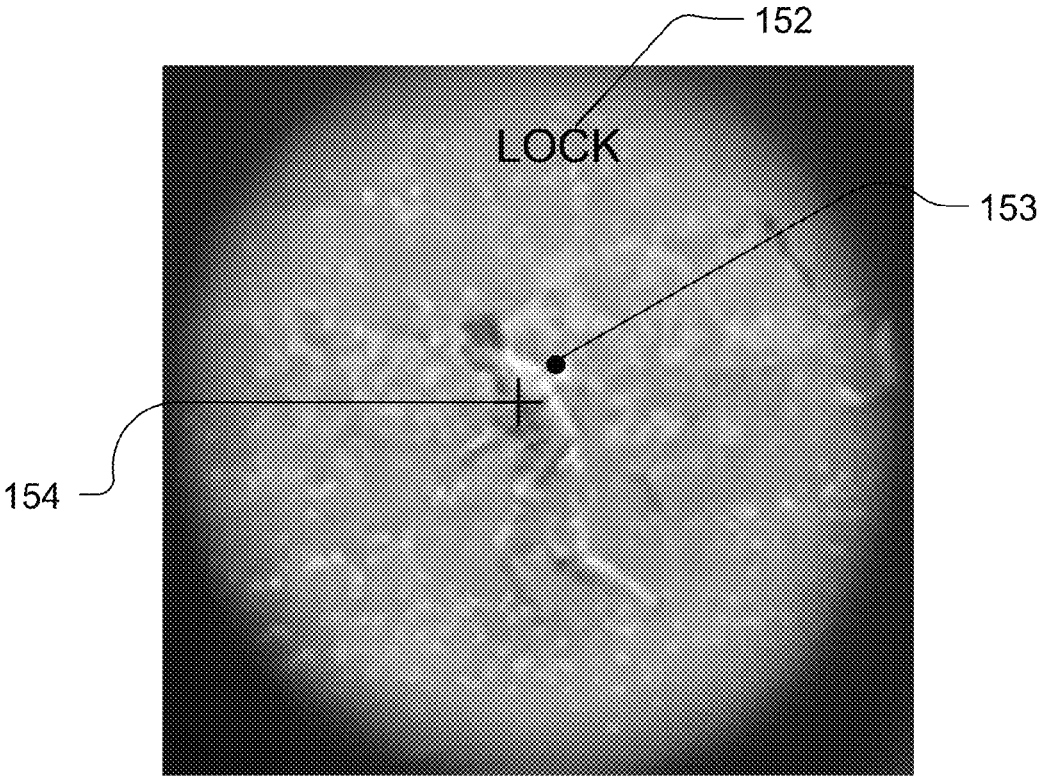
FIG. 34 shows a screen capture from an LCD display of an optical module displaying a lock on a closest target of the rifle shown in FIGS. 22 and 23 incorporating another embodiment of the active stabilization targeting correction of the present invention.

In the second processing path, in Block 1728 a position of target measurement relative to the point-of-aim is made. A visual display generated by the embedded processor is sent to the shooter through Optical Target Tracking Device 4/34/54 indicating "Lock" such as Lock Indicator 152 along with Instantaneous Aiming Point 153 as shown in FIG. 34. In Block 1730, the data from Block 1728, and optionally from Block 1726, is used to make an angular deflection calculation from the position of the target to the point-of-impact. In Block 1732 aiming errors due to man-machine wobble, horizontal and vertical, are calculated. In Block 1734, the horizontal aiming correction is sent to the electromechanical actuator in order to adjust the horizontal position of the isolated components of the Firearm 30/50/80. Simultaneously, In Block 1736, the vertical aiming correction is sent to the electromechanical actuator in order to adjust the vertical position of the isolated components of the firearm. In Block 1738 the results of the horizontal and vertical adjustments are summed in order to present a visual display to the shooter. In Block 1740 the visual display is presented to the shooter in Optical Target Tracking Devices 4/34/54 of the predicted point-of- impact, such as Predicted Point-of-Impact 154 shown in FIG. 34. One skilled in the art will recognize that due to the speed of the processing involved, there is virtually no noticeable time delay to the shooter between the display generated from block 3528 and the display generated from block 3540. Finally, in Block 1742 a firing decision needs to be made by the shooter. If the decision is yes, the shooter will pull the trigger on the firearm, deactivating the active stabilization targeting correction. The active stabilization targeting correction can be repeated for a next target by establishing a new point-of-aim and pressing again the targeting activation button. If the decision by the shooter is no, the trigger is not pulled. The method can then be repeated for a next target by releasing the targeting activation button which deactivates the active stabilization targeting correction, establishing a new point-of-aim, and pressing again the targeting activation button.

Figure 18:
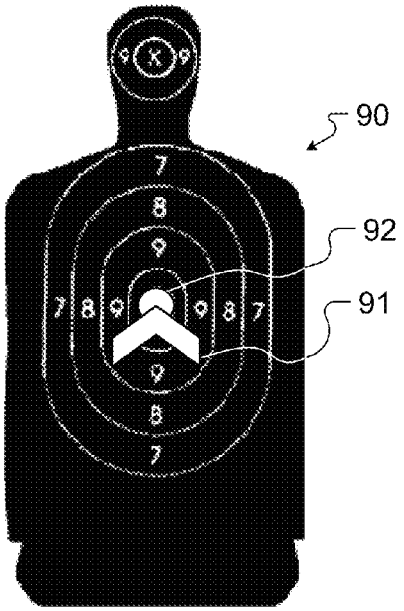
FIGS. 18-21 show an example target with respect to point-of-aim and point-of-impact under different conditions.
Figure 19:
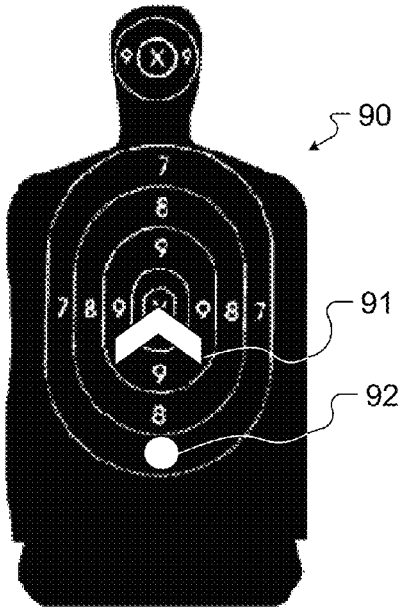

FIGS. 18-21 show an example target with respect to point-of-aim and point-of-impact under different conditions. Referring now to FIG. 18, the upper tip of White Chevron 91 indicates the point-of-aim (POA). White Circle 92 indicates the probable point-of-impact (POI) when Target 90 is at "zero" range and a shot is fired with no cross-wind. For longer shots, gravity pulls the projectile's POI below the POA unless elevation corrections are made to the aiming system. FIG. 19 shows the probable POI represented by White Circle 92 below the POA represented by White Chevron 91 when Target 90 is beyond "zero" range. The reverse occurs when Target 90 is closer than "zero" range—the POI will be above the POA unless elevation corrections are made to the aiming system (not shown).

Figure 20:
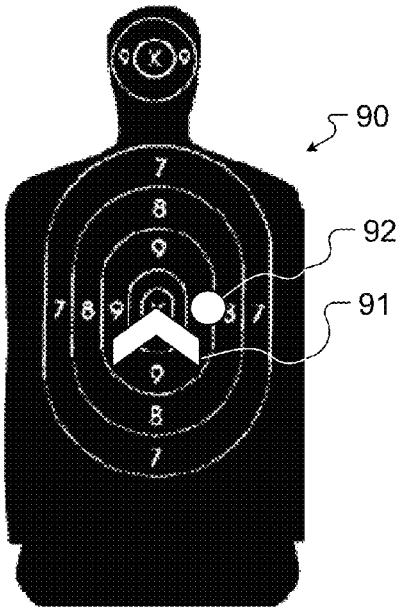

Cross-wind, spin-drift, and the Coriolis effect can each push the projectile's POI laterally from the POA unless windage corrections are made to the aiming system. FIG. 20 shows the POI represented by White Circle 92 moved laterally to the right with respect to the POA represented by White Chevron 91 due to one or more of these conditions.

Figure 21:
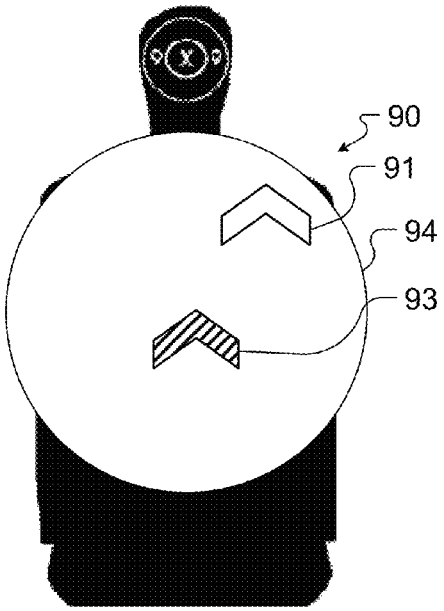

Man-machine wobble from fatigue, adrenalin, movement, defensive posture (standing, squatting, etc), or unsteady platforms (in the air in an aircraft, in a moving vehicle on the ground, or a marine vehicle, etc.) induces a nearly random displacement of the weapon and sighting system that results in a probable POI area that is much larger than in ideal conditions and often results in misses or failure to incapacitate the target. FIG. 21 shows Target 90 in such a situation selected at some specific moment in time. Due to man-machine wobble, the probable POI represented by White Circle 94 is much larger with respect to Target 90. The POA before correction of man-machine wobble is represented by White Chevron 91. A predicted POA is represented by Striped Chevron 93 that was detected and calculated by the target acquisition system, accounted for in the solution that directs the barrel pointing actions, and displayed to the shooter for a firing decision. This correction will occur at a higher frequency than most man-machine wobble, thus improving the likelihood that the target will be hit and incapacitated.

Figure 22:
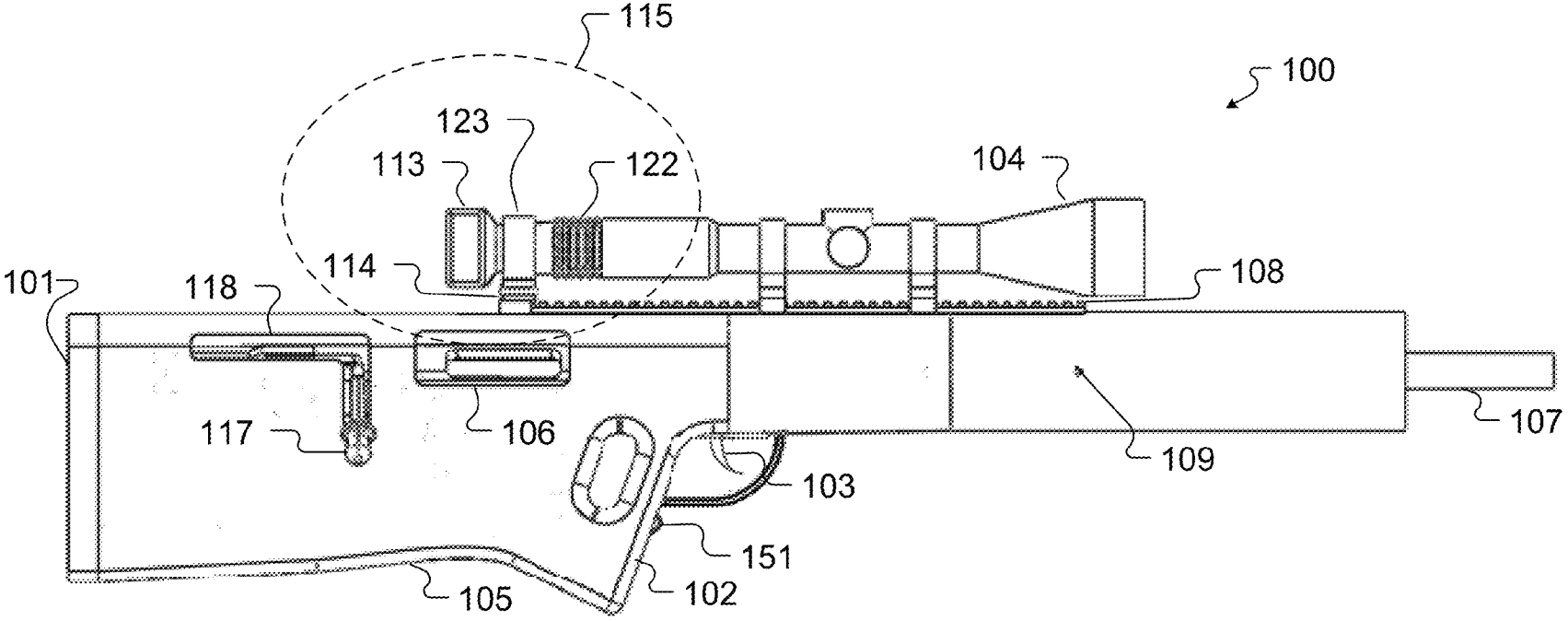
FIG. 22 shows an elevation view of a rifle incorporating another embodiment of the active stabilization targeting correction of the present invention.
Figure 23:
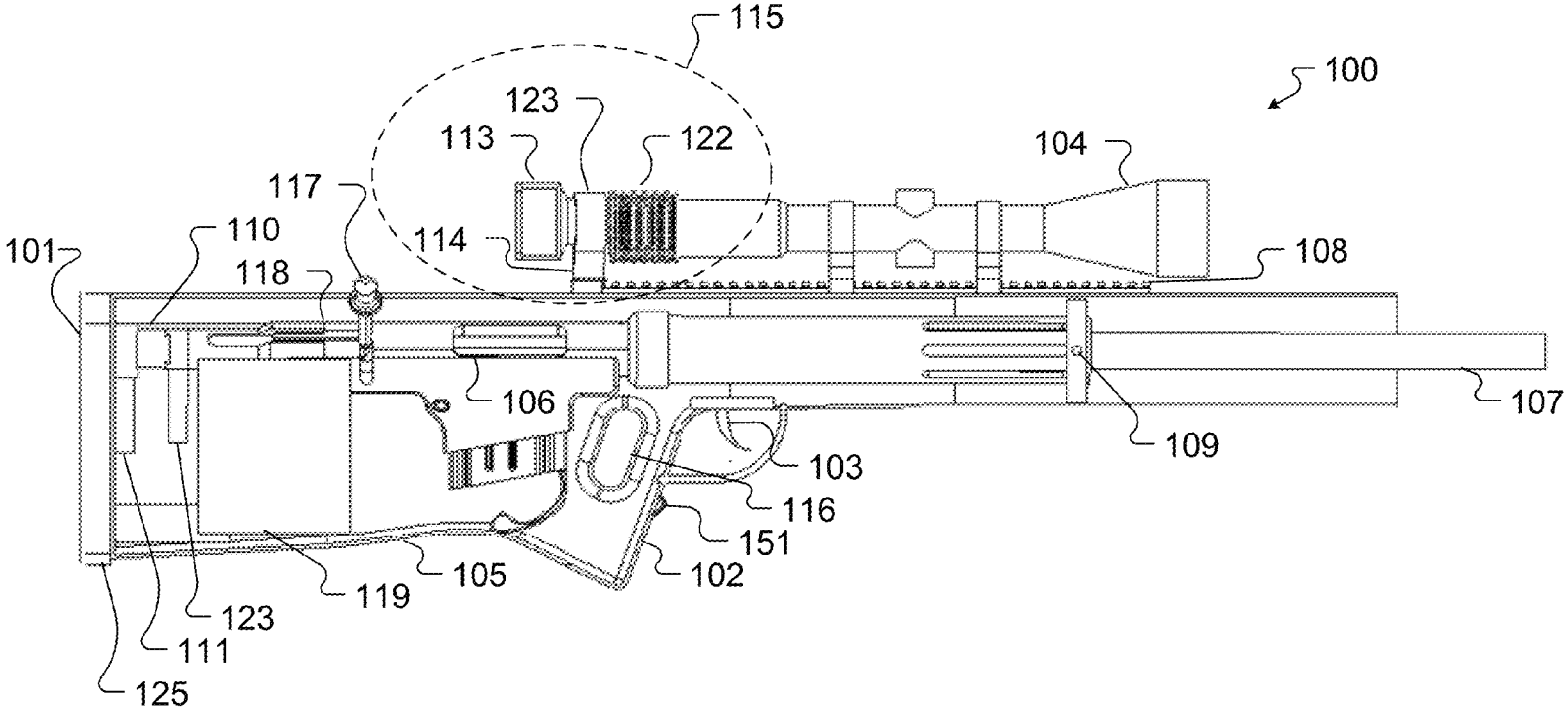
FIG. 23 shows a partial cutaway view of the internal components of the rifle shown in FIG. 22.

FIG. 22 shows an elevation view of a rifle incorporating another embodiment of the active stabilization targeting correction of the present invention and FIG. 23 shows a partial cutaway view of the internal components of the rifle shown in FIG. 22. Referring now to FIGS. 22 and 23, the active stabilization targeting correction system is shown in conjunction with a functional prototype of a semi-custom commercial sniper weapon, such as a McMillan Spec-Tac-LR rifle. The active stabilization targeting correction system works by separating the "support" features of the rifle from the "projectile launching" features, and controlling their respective motion by electromechanical mechanisms. FIGS. 22 and 23 illustrate a functional configuration of the active stabilization targeting correction system. Actual manufactured hardware may be of different shapes and designs for particular applications than that shown in FIGS. 22 and 23.

In FIGS. 22 and 23, Firearm 100 has Buttstock 101, Hand Grip 102, Trigger 103, Optical Target Tracking Device 104, and Optical Module 115, all of which are solidly mounted to Carriage Shell Stock 105, which also serves as a fore grip for the shooter. Buttstock 101, Hand Grip 102, Trigger 103, Optical Target Tracking Device 104, Optical Module 115, and Carriage Shell Stock 105 constitute the only points of interface or support of the shooter with Firearm 100, hereinafter referred to as the "Interface Components." Carriage Shell Stock 105 houses the majority of the stabilization system hardware and enables unencumbered movement of the projectile launching features of Firearm 100 within the bounds of the mechanical limits of Carriage Shell Stock 105. Thumb Hole 116 in Carriage Shell Stock 105 receives the thumb of the shooter's hand. Bolt Handle 117 extends out of and travels within L-Channel 118 in Carriage Shell Stock 105. The remaining elements of Firearm 100 are isolated from the shooter and comprise the projectile launching components of Firearm 100.

The Receiver 106 handles cartridge loading and unloading mechanisms. Along the exterior of Carriage Shell Stock 105 is an extended length Accessory Rail 108 affixed along the top of Carriage Shell Stock 105 for mounting Optical Target Tracking Device 104, which may include night, thermal, and fused imagers. Additional accessory rails can also be added to the sides and bottom of Carriage Shell Stock 105 for additional accessory mounting. Barrel 107 is movably mounted to Carriage Shell Stock 105 at two points: a two-degree-of-freedom (2-DOF) Gimbals 109 and windage-elevation Guide Block Assembly 110. Accessory Rail 108 may be a Picatinny rail or a Weaver rail or any proprietary or universal rail system. Receiver 106, and Barrel 107 are isolated from the shooter, hereinafter referred to as the "Isolated Components."

Figure 24:
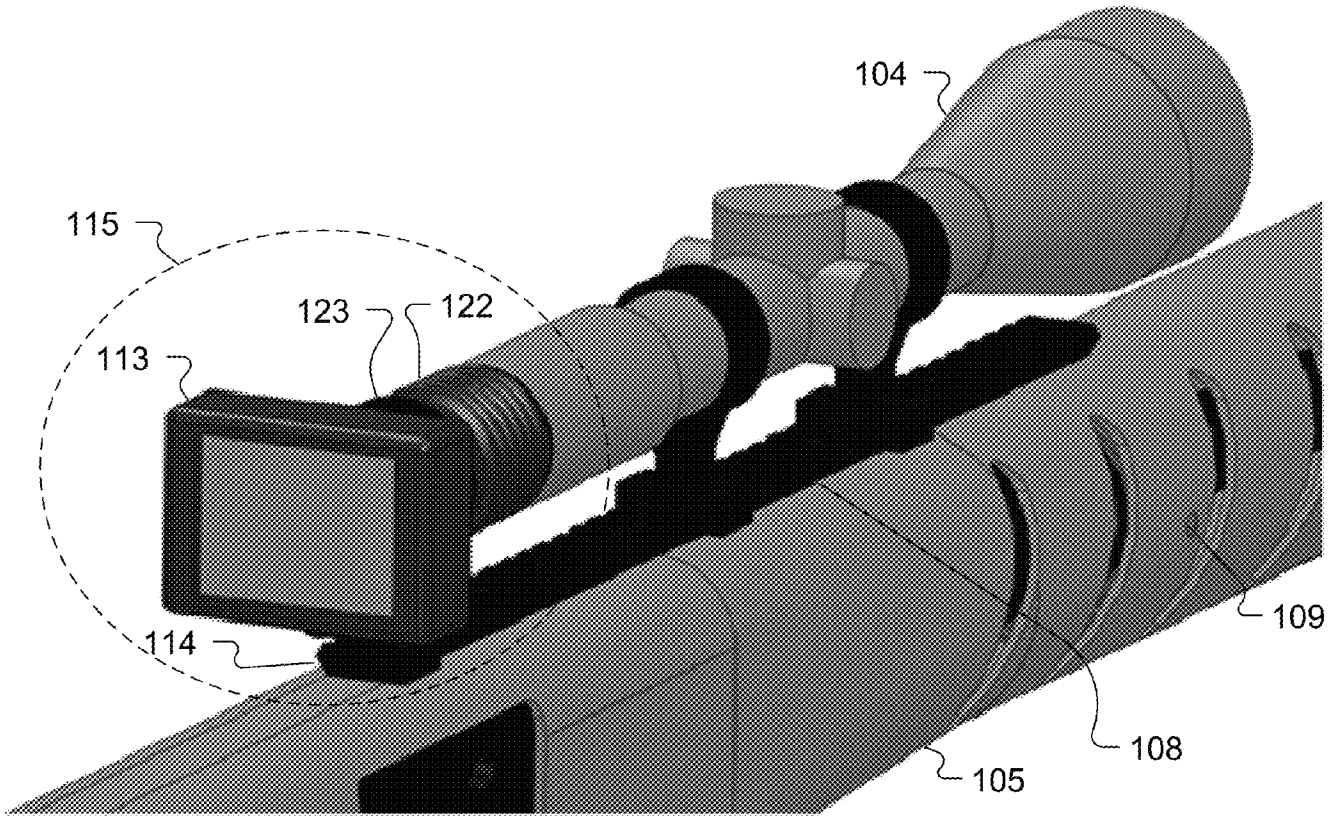
FIG. 24 shows a perspective view of the optical module of the rifle shown in FIGS. 22 and 23.

FIG. 24 shows a perspective view of the optical module of the rifle shown in FIGS. 22 and 23. Referring now to FIG. 24, Optical Module 115 has a flexible Boot 122 that is removably connected to Optical Target Tracking Device 104. Boot 122 keeps out light and dust in the space between Optical Module 115 and Optical Target Tracking Device 104. Tilt-Ring Mount 114 secures Optical Module 115 to Accessory Rail 108. Optical Module 115 contains a commercial USB Camera 123 to gather an image of the target through the main optic, Optical Target Tracking Device 104. USB Camera 123 may be a ¼" imager chip with a 6 mm M12-type lens, or any other suitable combination of camera and lens. On the other side of Optical Module 115 is Liquid Crystal Display ("LCD Display) 113 that relays the targeting image along with corrected aim-point and target-lock information to the shooter. LCD Display 113 may be a CINSR-1835 2", 176×132 pixel LCD display, or any other suitable LCD display. The CINSR-1835 2", 176×132 pixel LCD display is the same unit used in commercial IPod music players and is low-cost, rugged, and reliable. In the case of any targeting system failure, the shooter may simply tilt Optical Module 115 to the side via Tilt-Ring Mount 114, which may be a Larue Tactical LT755 Pivot Mount or a Burris AR-Pivot Mount, with Boot 122 remaining attached to the optical module, and continue using the rifle in the standard manner without assisted stabilization. With this embodiment, different types of Optical Target Tracking Devices 104 may be swapped in and out and mounted to Accessory Rail 108, and Tilt-Ring Mount 114 with Boot 122 adjusted to line up with each new Optical Target Tracking Devices 104 so mounted, giving the shooter greater flexibility depending upon the situation and need.

Figure 25:
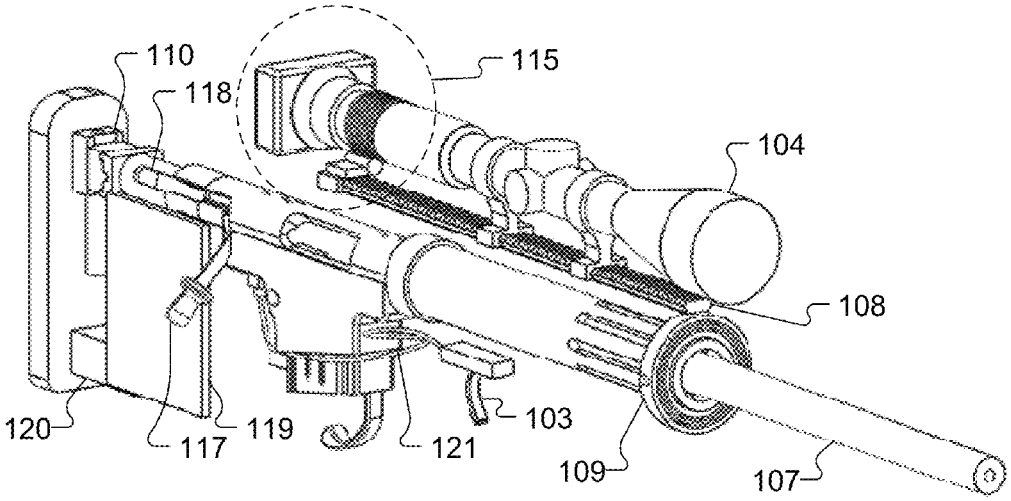
FIG. 25 shows an isometric view of the internal components of a rifle shown in FIGS. 22 and 23 incorporating another embodiment of the active stabilization targeting correction of the present invention.
Figure 26:
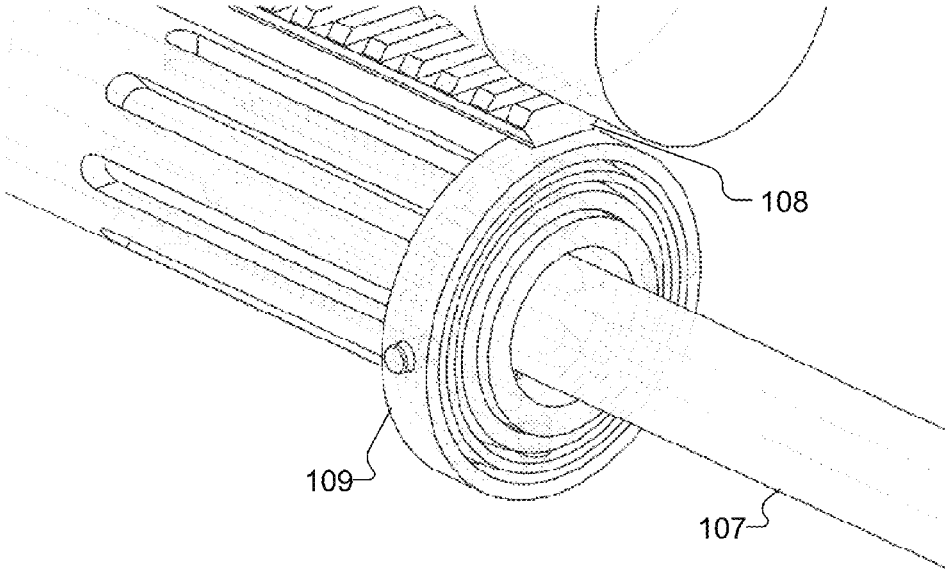
FIG. 26 shows an enlarged isometric view of an embodiment of the gimbals shown in FIG. 25.
Figure 27:
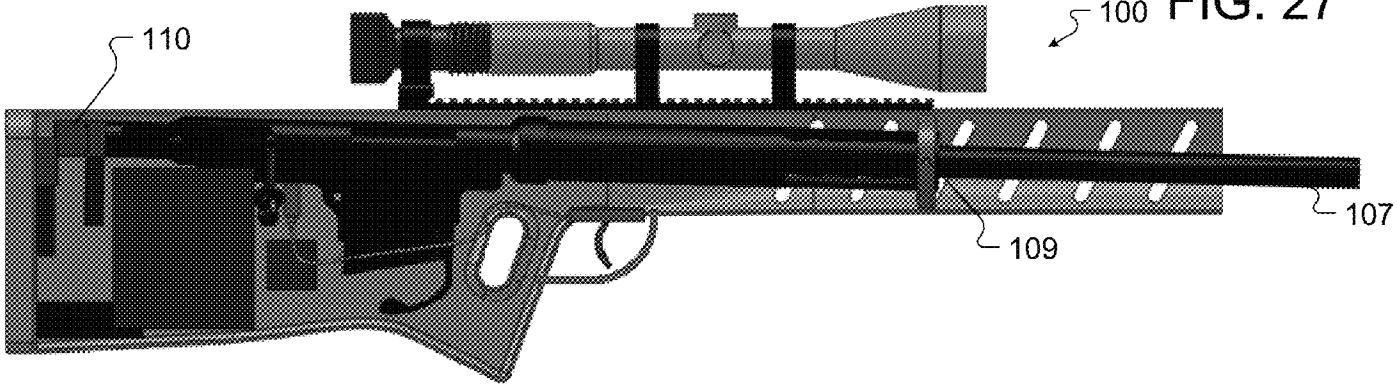
FIG. 27 shows a full "down corrected" position of the rifle shown in FIG. 22 incorporating another embodiment of the active stabilization targeting correction of the present invention.
Figure 28:
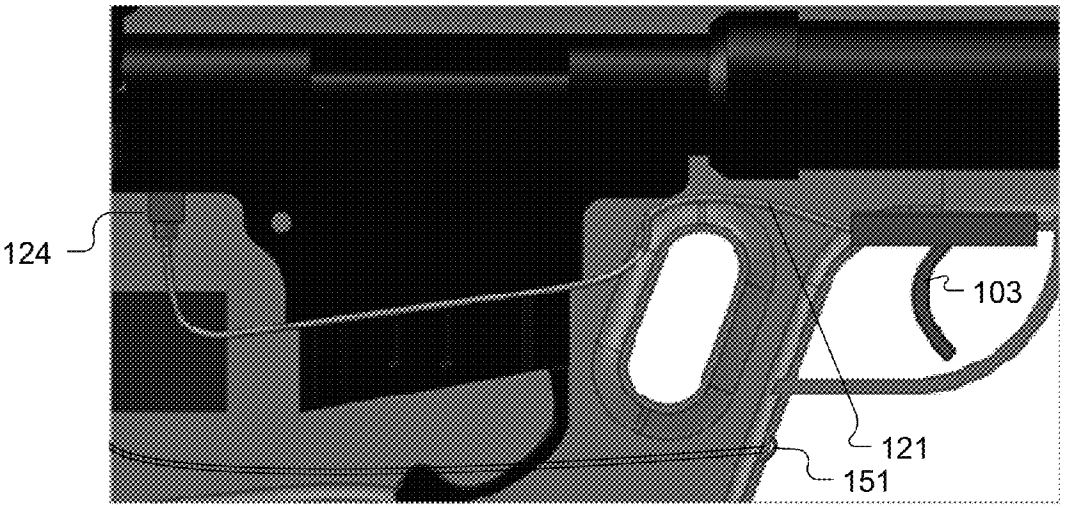
FIG. 28 shows an enlarged view of a trigger assembly of a rifle shown in FIGS. 22 and 23 incorporating another embodiment of the active stabilization targeting correction of the present invention.

FIG. 25 shows an isometric view of the internal components of the rifle shown in FIGS. 22 and 23, FIG. 26 shows an enlarged isometric view of an embodiment of the gimbals shown in FIG. 25, and FIG. 28 shows an enlarged view of a trigger assembly of a rifle shown in FIGS. 22 and 23 incorporating another embodiment of the active stabilization targeting correction of the present invention. Referring now to FIGS. 25, 26, and 28, mounted in the fore-stock of Carriage Shell Stock 105 is a two-degree-of-freedom (2-DOF) precision Gimbals 109 that affixes the rifle's forestock to Carriage Shell Stock 105 to allow for pan and tilt of the isolated components (see FIGS. 23 and 27). A precision Guide Block Assembly 110 attaches internally to Buttstock 101 of Carriage Shell Stock 105 (FIG. 23) and mounts high-speed, high-torque, zero-backlash Vertical Actuator 111 and Horizontal Actuator 112 that impart horizontal and vertical corrections of as much as 10 MRAD total translation (FIG. 27). Depending upon the design of the carriage shell stock, total translation of more than 10 MRAD may be achieved for horizontal and vertical corrections. Vertical Actuator 111 and Horizontal Actuator 112 may be stepper motors, linear actuators, piezoelectric actuators, screw transducers, hydraulic, pneumatic, or any other type of actuator capable of the micro movements required. More translation can be accommodated with a larger Carriage Shell Stock 105.

Guide Block Assembly 110 features curved slide surfaces to resist all recoil forces with normal contact forces, thus relieving Actuators 122 and 123 from recoil loads. A trigger linkage system (electromechanical in the sniper platform, mechanical in battle rifles and carbines) allows Trigger Assembly 121 mounted with the Hand Grip 102 of Carriage Shell Stock 105 to actuate Sear Actuator 124 on the receiver (FIG. 28). Innovative designs for the sear actuator such as stacked piezo-crystals offer inherently low power consumption and high reliability. Trigger Assembly 121 in Carriage Shell Stock 105 now only needs to close a circuit for Sear Actuator 124, enabling light, crisp, and safe triggers, all in one package. For weapons that don't require a light trigger, a cable-in-sheath mechanical linkage (not shown) will activate Sear Actuator 124 from Trigger 103 input with standard trigger feel. The outer ring of Gimbals 109 is pressed into Carriage Shell Stock 105 and is pinned to the middle ring horizontally. The inner ring of Gimbals 109 is pressed onto the fore end of Barrel 107 and pinned to the middle ring vertically. Battery 120 supplies power to Mobile Processing Unit 119.

FIG. 27 shows a full "down corrected" position of rifle shown in FIG. 22 incorporating another embodiment of the active stabilization targeting correction of the present invention. Referring now to FIG. 27, the isolated components are shown suspended between the 2-DOF Gimbals 109 in the fore-stock area and Guide Block Assembly 110 in the Buttstock 101 area. At the full "down-corrected" position shown in FIG. 27, Guide Block Assembly 110 exhibits half of its full elevation travel (5 of 10 MRADs), and the isolated components have reached the limits of their movement inside Carriage Shell Stock 105. Similarly, the pan (horizontal) corrections are limited by the width of Carriage Shell Stock 105 at the Buttstock 101 end. Full pan travel may typically be up to 10 MRAD for rifles, and up to 20 MRAD for machine guns, handguns, and shotguns depending upon the design of the carriage shell stock.

Figure 29:
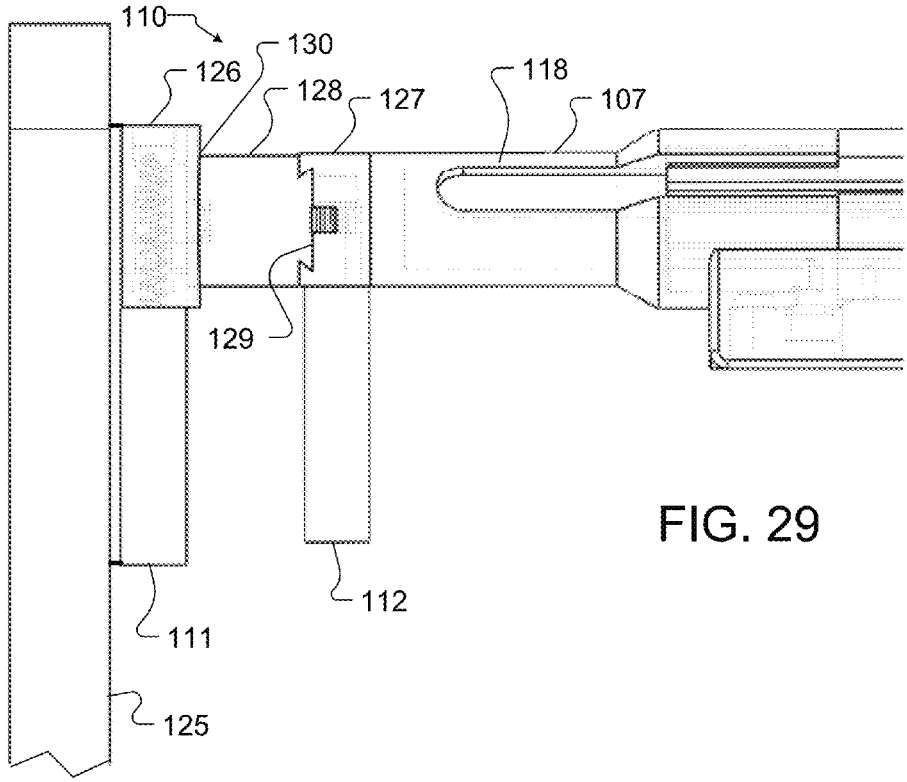
FIG. 29 shows a side view of the guide block assembly of the rifle shown in FIG. 23 incorporating another embodiment of the active stabilization targeting correction of the present invention.
Figure 30:
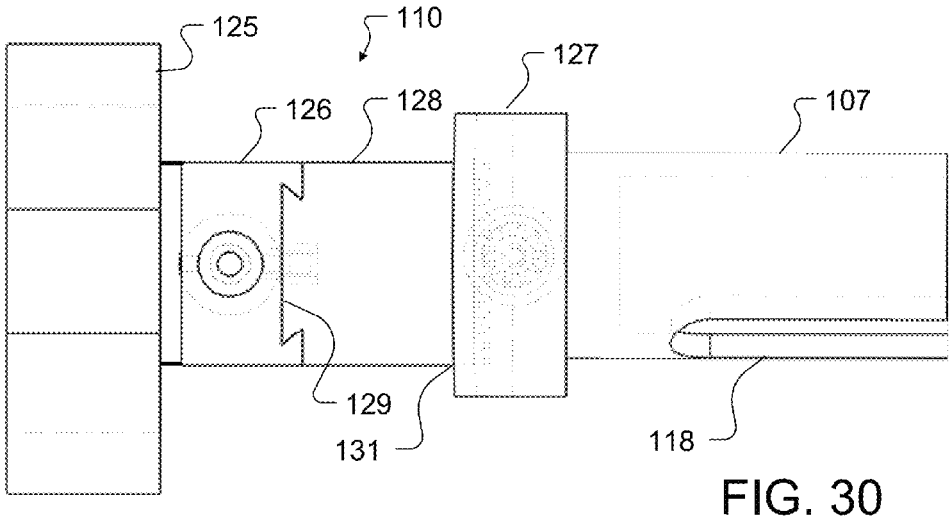
FIG. 30 shows a top view of the guide block assembly of the rifle shown in FIG. 23 incorporating another embodiment of the active stabilization targeting correction of the present invention.

FIG. 29 shows a side view, FIG. 30 shows a top view, and FIG. 31 shows a perspective view of the guide block assembly of the rifle shown in FIG. 23 incorporating another embodiment of the active stabilization targeting correction of the present invention. Referring now to FIGS. 29, 30, and 31, Base Plate 125 is securely attached to Buttstock 101. Vertical Actuator 111 actuates Vertical Drive 126, which in one embodiment is a lead screw type drive. Horizontal Actuator 112 actuates Horizontal Drive 127, which in one embodiment is a rack and pinion type drive. However, each drive may be one of several different types listed above. Connector Block 128 fits within Groves 129 within both Vertical Drive 126 and Horizontal Drive 127. The Interface 130 between the abutted surfaces of Vertical Drive 126 and Connector Block 128 as shown in FIG. 29 are curved. The radius of the curve of the abutted surfaces runs from Interface 130 to the pivot point defined by Gimbals 109. This provides for smooth sliding between the abutted surfaces of Vertical Drive 126 and Connector Block 128 when elevation changes, or tilt, are made by Vertical Actuator 111 in the direction indicated by Arrow 132 (see FIG. 32). The Interface 131 between the abutted surfaces of Horizontal Drive 127 and Connector Block 128 as shown in FIG. 30 are curved. The radius of the curve the abutted surfaces runs from Interface 131 to the pivot point defined by Gimbals 109. This provides for smooth sliding between the abutted surfaces of Horizontal Drive 127 and Connector Block 128 when horizontal changes, or pan, are made by Horizontal Actuator 112 in the direction indicated by Arrow 133 (see FIG. 32).

FIG. 32 shows a board used for data processing for the rifle shown in FIGS. 22 and 23 incorporating another embodiment of the active stabilization targeting correction of the present invention. Referring now to FIG. 32, Mobile Processing Unit 119 houses Board 134. In one embodiment of the invention, Board 134 is a PandaBoard, an open OMAP™ 4 mobile software development platform which has a Processor 135. In one embodiment, Processor 135 features Texas Instruments OMAP 4430 processor designed to drive smart-phones. Board 134 is at the center of all the image collection, target identification/tracking, actuator controlling, and targeting feedback display duties. JTAG 136 is an IC debug port. WLAN/Bluetooth 137 provides local communications with alternate hardware such as telecommunication devices, additional diagnostics, external processing centers, etc. Expansion Connector 138 is available but not used at this time. LCD Expansion 139 provides the video out to LCD Display 113. DVI Out 140 and HDMI Out 141 are available and HDMI may be utilized for external monitors such as a soldier heads-up-display. Ethernet and USB Ports 142 provide extended external communications. Power/Reset Buttons 143 and Stereo Audio In/Out 145 are available but not used at this time. Power Supply 144 receives voltage from Battery 120. USB 146 provides motor control to Vertical Actuator 111 and Horizontal Actuator 112. Camera Connector 147 receives signals from USB Camera 123. Serial/RS-232 148 receives input from Targeting Button 151 (see FIG. 28). SD/MMC Card Slot 149 receives the Secure Digital ("SD") card which has the operating system and the image detection software. Status LEDs 150 are used for internal diagnostics.

In one embodiment, Board 134 possesses all of the features listed below:

Core Logic: OMAP4430 applications processor.

Display: HDMI v1.3 Connector (Type A) to drive HD displays;

DVI-D Connector (can drive a 2nd display, simultaneous display, requires HDMI to DVI-D adapter); and LCD expansion header.

Memory: 1 GB low power DDR2 RAM; and

Full size SD/MMC card cage with support for High-Speed & High-Capacity cards.

Connectivity: Onboard 10/100 Ethernet.

Wireless Connectivity: 802.11 b/g/n (based on WiLink™ 6.0); and

Bluetooth® v2.1+EDR (based on WiLink™ 6.0).

Audio: 3.5" Audio in/out; and

HDMI Audio out.

Expansion: 1× USB 2.0 High-Speed On-the-go port;

2× USB 2.0 High-Speed host ports;

General purpose expansion header (I2C, GPMC, USB, MMC, DSS, ETM); and

Camera expansion header.

Dimensions: Height: 4.5" (114.3 mm);

Width: 4.0" (101.6 mm); and

Weight: 2.6 oz (74 grams).

Debug: JTAG;

UART/RS-232;

2 status LEDs (configurable); and

1 GPIO Button.

In one embodiment, some features of Processor 135 are listed below:

Designed to drive smart phones, tablets and other multi-media-rich mobile devices;

IVA 3 hardware accelerators enable full HD 1080p, multi-standard video encode/decode;

Faster, higher-quality image and video capture with digital SLR-like imaging up to 20 megapixels;

Dual-core ARM® Cortex™-A9 MPCore™ with Symmetric Multiprocessing (SMP);

Integrated POWERVR™ SGX540 graphics accelerator drives 3D gaming and 3D user interfaces;

Highly optimized mobile applications platform; and

OMAP4430 operates at up to 1 GHz.

In one embodiment, the hardware will support three popular open source mobile operating systems: a light and fast one called Angstrom, a very usable one called Ubuntu, and the Android™ OS. Swapping out the software platform is as simple as inserting a different SD card into SD/MMC Card Slot 149.

Power for the system is currently drawn from Battery 120, which in one embodiment is an internal Li-Po battery pack which is fully rechargeable. Other embodiments can be configured to be powered by removable primary batteries, a universal power bus, or an external power supply. Power requirements are dependent on situational factors.

Target tracking systems, in general, receive a digitized video signal and optically detect the location of persons of interest, i.e., potential targets. The output from these systems is typically twofold: 1) a marker of all potential targets in the field of view, and 2) a vertical and horizontal angular deflection from the primary target's center of mass to the camera's center of view or the weapon optic's point of aim (POA). These deflection measurements are used to control (or stabilize) the direction of any number of devices such as the laser rangefinders mentioned above.

Figure 33:
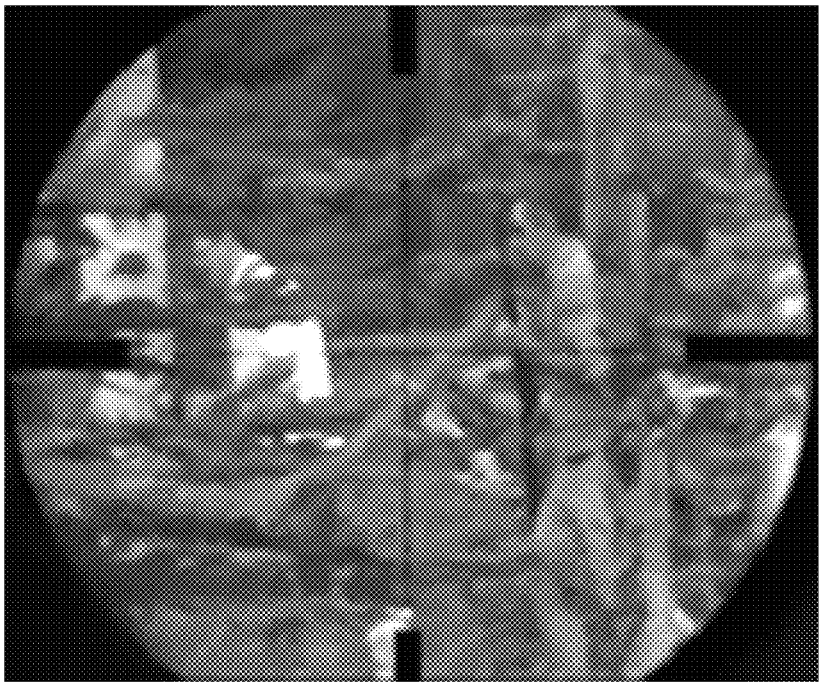
FIG. 33 shows a screen capture from an LCD display of an optical module displaying multiple targets of the rifle shown in FIGS. 22 and 23 incorporating another embodiment of the active stabilization targeting correction of the present invention.

The image detection software is the brain of the stabilization system. OpenCV (Open Source Computer Vision Library) computer vision libraries are utilized to identify all targets in the field of view (see FIG. 33), and custom code "snap-to-target" capability selects the closest target to the aim point for target lock. Once target lock is achieved, firearm stabilization is activated (see FIG. 34). Lock Indicator 152 is displayed, along with Instantaneous Aiming Point 153 and Predicted Point-of-Impact 154. If a fire decision is made by the shooter at this point, the target should be hit at or near Predicted Point-of-Impact 154. If the system is provided range and trajectory data, it can also compensate for moving target aiming lead. The software calculates the speed of the target relative to its background or surroundings and superimposes this lead correction onto the man-machine wobble correction.

Figure 35:
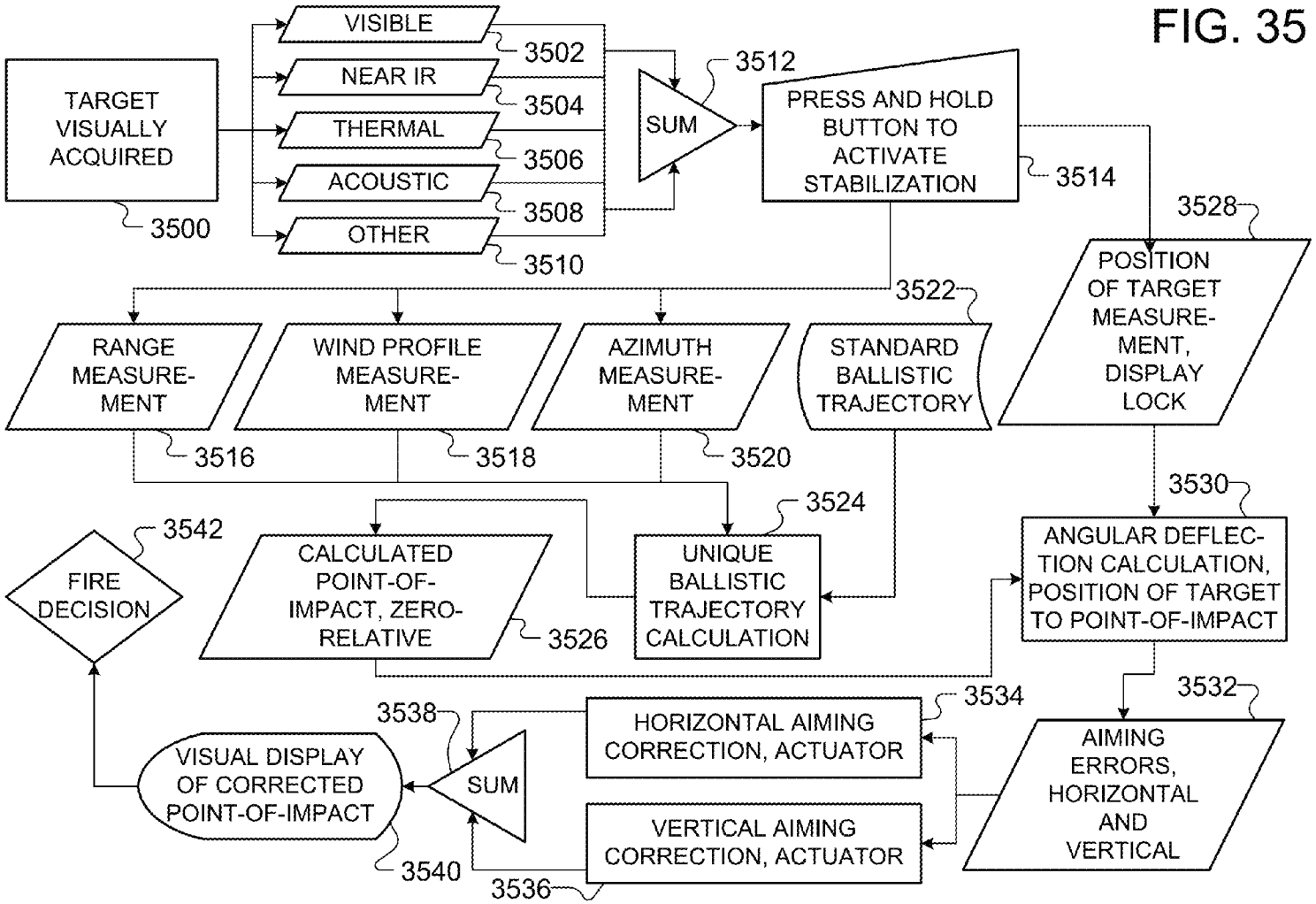
FIG. 35 shows a flow diagram of a method of utilizing another embodiment of the active stabilization targeting correction of the present invention.

FIG. 35 shows a flow diagram of a method of utilizing another embodiment of the active stabilization targeting correction of the present invention. Referring now to FIG. 35, the method begins with Block 3500 where a target is visually acquired by a shooter aiming a firearm, such as Firearm 100, and its associated optics, such as Optical Target Tracking Device 104 and Optical Module 115, at a target, establishing a point-of-aim. Next, signals are generated by Optical Target Tracking Device 104 and in some embodiments, by other types of target detection devices in Blocks 3502-3510. The signals may be generated from visible light, near IR light, thermal imagery, acoustics, or any other type of target detecting signal. Particular embodiments may only employ one, two, or some other combination of the possible data acquisition systems. In Block 3512 all of the signals generated are summed, thus reducing the noise. In block 3514, the active stabilization targeting correction is activated when the shooter presses and holds a button, which is typically located on or near the grip of the dominant hand of the shooter so that the button is automatically depressed when the shooter grasps the hand grip tightly and generates an activation signal. The button is in electrical communication with Processor 135 in Optical Module 115.

Dual processing takes place after Block 3514. In the first processing path, in Block 3516 a range measurement is calculated, typically through a laser range finder system. In Block 3518 a wind profile measurement is calculated, typically through laser scattering. In Block 3520, an azimuth measurement is taken, typically through an electronic compass. In Block 3524, a unique ballistic trajectory is calculated with the data from Blocks 3516, 3518, and 3520 along with stored standard ballistic trajectory data from Block 3522. In Block 3526 a point-of-impact, zero-relative, is calculated. Depending upon the firearm in question, the data collected and generated in Blocks 3516-3526 is not needed in order to correct for man-machine wobble. For example, for a high powered rifle aiming at a target at less than 200 meters, the data generated from Blocks 3516-3526 would not alter significantly the man-machine wobble corrections generated in Block 3530.

In the second processing path, in Block 3528 a position of target measurement relative to the aiming point is made. A visual display generated by Processor 135 is sent to the shooter through LCD Display 113 indicating "Lock" such as Lock Indicator 152 along with Instantaneous Aiming Point 153 as shown in FIG. 34. In Block 3530, the data from Block 3528, and optionally from Block 3526, is used to make an angular deflection calculation from the position of the target to the point-of-impact. In Block 3532 aiming errors due to man-machine wobble, horizontal and vertical, are calculated. In Block 3534, the horizontal aiming correction is sent to the electromechanical actuator in order to adjust the horizontal position of the isolated components of Firearm 100. Simultaneously, In Block 3536, the vertical aiming correction is sent to the electromechanical actuator in order to adjust the vertical position of the isolated components of Firearm 100. In Block 3538 the results of the horizontal and vertical adjustments are summed in order to present a visual display to the shooter. In Block 3540 the visual display is presented to the shooter in LCD Display 113 of Optical Module 115 of the predicted point-of-impact, such as Predicted Point-of-Impact 154 shown in FIG. 34. One skilled in the art will recognize that due to the speed of the processing involved, there is virtually no noticeable time delay to the shooter between the display generated from block 3528 and the display generated from block 3540. Finally, in Block 3542 a firing decision needs to be made by the shooter. If the decision is yes, the shooter will pull the trigger on the firearm, deactivating the active stabilization targeting correction. The active stabilization targeting correction can be repeated for a next target by establishing a new point-of-aim and pressing again the targeting activation button. If the decision by the shooter is no, the trigger is not pulled. The method can then be repeated for a next target by releasing the targeting activation button which deactivates the active stabilization targeting correction, establishing a new point-of-aim, and pressing again the targeting activation button.

The concept is applicable to smaller weapons such as handguns provided that the components will fit within the frame of the handguns. For weapons that are too small, the shooter may "wear" the processor and battery with an umbilical cord running to the handgun to provide active stabilization targeting correction to the handgun.

Having described the present invention, it will be understood by those skilled in the art that many changes in construction and circuitry and widely differing embodiments and applications of the invention will suggest themselves without departing from the scope of the present invention. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for reducing aiming errors of a handheld firearm, the firearm having a frame with a barreled action connected to the frame by an adjustable actuator, the method comprising the steps of:

(a) establishing a point-of-aim of the handheld firearm at a target;

(b) generating a signal by an optical target tracking device and receiving the optical target tracking device signal in a mobile processor;

(c) measuring by the mobile processor a position of target relative to the point-of-aim;

(d) generating by the mobile processor a user-perceptible signal indicating target lock;

(e) calculating by the mobile processor an angular deflection based upon measuring step (c);

(f) calculating by the mobile processor an aiming error of the handheld firearm caused by the angular deflection;

(g) sending by the mobile processor an aiming correction signal to the actuator;

(h) adjusting the actuator based on the aiming correction signal to adjust a position of the barreled action relative to the frame to correct the aiming error; and (i) presenting by the mobile processor a visual display in a display device of a predicted point-of-impact on the target based on the aiming correction signal.

2. The method according to claim 1 wherein step (b) comprises the steps of:

(j) generating one or more measurement signals from one or more other target detection devices associated with the handheld firearm; and (k) summing by the mobile processor the one or more signals from generating step (j) along with the signal generated by the optical target tracking device to reduce noise.

3. The method according to claim 1 further comprising the steps of:

(j) calculating a range measurement with a range measurement system associated with the handheld firearm;

(k) calculating a wind profile measurement with a wind profile measurement system associated with the handheld firearm;

(l) taking an azimuth measurement with an azimuth measurement system associated with the handheld firearm;

(m) retrieving standard ballistic trajectory data stored in a memory in communication with the mobile processor; and (n) calculating by the mobile processor a unique ballistic trajectory based on the measurements from steps (j), (k), and (l) and the standard ballistic trajectory data from step (m).

4. The method according to claim 1 further comprising the step of:

(j) calculating by the mobile processor a point-of-impact, zero relative.

5. The method according to claim 4 wherein step (e) further comprises the step of:

utilizing the point-of-impact, zero relative calculated in step (i) in calculating the angular deflection.

6. The method according to claim 1 wherein step (b) further comprises the step of:

generating an activation signal and receiving the activation signal in the mobile processor.

7. The method according to claim 6 wherein step (b) further comprises the step of:

generating the activation signal through a targeting button located on the handheld firearm.

8. The method according to claim 6 further comprising the steps of:

(j) receiving a loss of activation signal in the mobile processor either from a firing decision or a non-firing decision; and (k) deactivating the method for reducing aiming errors of the handheld firearm.

9. The method according to claim 1 wherein step (f) further comprises the step of:

calculating by the mobile processor a horizontal aiming error and a vertical aiming error caused by the angular deflection.

10. The method according to claim 1 wherein step (g) further comprises the steps of:

(j) sending by the mobile processor a horizontal aiming correction signal to a horizontal actuator in order to adjust a horizontal position of the barreled action relative to the frame to correct the horizontal aiming error; and (k) sending by the mobile processor a vertical aiming correction signal to a vertical actuator in order to adjust a vertical position of the barreled action relative to the frame to correct the vertical aiming error.

11. The method according to claim 10 wherein step (i) further comprises the step of:

presenting by the mobile processor a visual display in a display device of a predicted point of impact on the target based on the horizontal aiming error and the vertical aiming error.

12. The method according to claim 1 wherein the angular deflection calculated by the mobile processor in step (e) is caused by at least one of the group consisting of man-machine wobble of the handheld firearm and target movement.

13. The method according to claim 1 step (d) further comprises the step of:

generating by the mobile processor a visual display in a display device indicating target lock.

14. A method for reducing aiming errors of a handheld firearm used by an operator, the firearm having a frame and a barreled action connected to the frame by an adjustable actuator, the method comprising the steps of:

the operator aligning the frame with the barreled action pointed toward a target zone including a target;

generating an image of target zone in an imager having a field of view;

transmitting the image to a processor;

the processor identifying the target and calculating location data establishing a location of the target in the field of view;

based on the location data, automatically adjusting the actuator to move the barreled action into effective alignment with the target while the frame is deviated from alignment from the target.

15. The method of claim 14 further comprising the step of continuously adjusting the actuator to maintain the effective alignment.

16. The method of claim 14, further comprising the step of presenting by the processor a visual display in a display device of a predicted point-of-impact on the target based on the effective alignment of the barreled action with the target.

17. The method of claim 14, further comprising the step of generating by the processor a user-perceptible signal indicating target lock.

18. The method of claim 14, further comprising the step of firing the firearm in response to a trigger input by the user.

19. The method of claim 14, wherein the step of moving the barreled action into effective alignment includes adjusting the barreled action position to compensate for bullet drop based on a measured distance to the target.

20. The method of claim 14, wherein the step of moving the barreled action into effective alignment includes adjusting the barreled action position to compensate for windage based on a measured wind condition.

21. The method of claim 14, wherein the step of moving the barreled action into effective alignment includes adjusting the barrel position based on an atmospheric condition.

22. The method of claim 21, wherein the atmospheric condition is selected from the group consisting of temperature, humidity, and barometric pressure.

* * * * *